US009303482B2

(12) United States Patent
Hall et al.

(10) Patent No.: US 9,303,482 B2
(45) Date of Patent: Apr. 5, 2016

(54) LANDING COLLAR

(71) Applicant: SCHLUMBERGER TECHNOLOGY CORPORATION, Sugar Land, TX (US)

(72) Inventors: James M. Hall, Dubai (AE); Cem Monur, Dubai (AE)

(73) Assignee: Smith International Inc., Houston, TX (US)

( * ) Notice: Subject to any disclaimer, the term of this patent is extended or adjusted under 35 U.S.C. 154(b) by 0 days.

(21) Appl. No.: 14/456,609

(22) Filed: Aug. 11, 2014

(65) Prior Publication Data

US 2014/0345852 A1 Nov. 27, 2014

Related U.S. Application Data

(62) Division of application No. 13/047,680, filed on Mar. 14, 2011, now Pat. No. 9,200,499.

(51) Int. Cl.

| | |
|---|---|
| ***E21B 23/00*** | (2006.01) |
| ***E21B 33/12*** | (2006.01) |
| ***E21B 23/02*** | (2006.01) |
| ***E21B 33/16*** | (2006.01) |
| *E21B 33/14* | (2006.01) |
| *E21B 33/08* | (2006.01) |

(52) U.S. Cl.

CPC ..... *E21B 33/12* (2013.01); *E21B 23/02* (2013.01); *E21B 33/16* (2013.01); *E21B 33/08* (2013.01); *E21B 33/14* (2013.01)

(58) Field of Classification Search

CPC ..... E21B 23/00; E21B 23/02; E21B 33/14; E21B 33/16; E21B 33/08; E21B 33/12; E21B 33/134

USPC ..... 166/153, 156, 188, 177.3, 386

See application file for complete search history.

(56) References Cited

U.S. PATENT DOCUMENTS

| | | | | |
|---|---|---|---|---|
| 2,445,882 | A * | 7/1948 | House | 277/438 |
| 3,205,948 | A * | 9/1965 | Preston, Jr. | 166/318 |
| 4,671,358 | A | 6/1987 | Lindsey et al. | |
| 5,018,579 | A | 5/1991 | Braddick et al. | |
| 5,020,597 | A * | 6/1991 | Braddick et al. | 166/291 |
| 5,390,736 | A | 2/1995 | Budde | |
| 5,413,172 | A * | 5/1995 | Laurel | 166/153 |
| 5,437,330 | A * | 8/1995 | Gambertoglio | 166/289 |
| 5,522,458 | A | 6/1996 | Watson et al. | |
| 5,692,564 | A * | 12/1997 | Brooks | 166/127 |
| 5,890,537 | A | 4/1999 | Lavaure et al. | |
| 6,082,451 | A | 7/2000 | Giroux et al. | |
| 6,206,094 | B1 | 3/2001 | Smith | |
| 6,571,880 | B1 | 6/2003 | Butterfield et al. | |
| 6,799,638 | B2 | 10/2004 | Butterfield | |
| 7,143,831 | B2 * | 12/2006 | Budde | 166/373 |
| 7,584,792 | B2 * | 9/2009 | Szarka | 166/291 |
| 7,686,092 | B2 * | 3/2010 | Szarka | 166/386 |
| 8,201,634 | B2 * | 6/2012 | Laurel et al. | 166/335 |
| 8,360,141 | B2 | 1/2013 | Smith | |
| 2002/0000318 | A1 | 1/2002 | Allamon et al. | |
| 2003/0230405 | A1 | 12/2003 | Allamon et al. | |
| 2010/0294503 | A1 | 11/2010 | Laurel et al. | |
| 2011/0232915 | A1 * | 9/2011 | Kellner et al. | 166/373 |

* cited by examiner

*Primary Examiner* — Kenneth L Thompson
*Assistant Examiner* — Michael Wills, III
(74) *Attorney, Agent, or Firm* — Michael Stonebrook

(57) ABSTRACT

A landing collar having a housing, a first sleeve configured to receive a lead wiper plug, and a latching mechanism configured to couple the first sleeve to an inner wall of the housing. The latching mechanism including a c-ring coupled to the housing and a landing insert disposed within the c-ring.

7 Claims, 14 Drawing Sheets

LANDING COLLAR

RELATED APPLICATION

This application is a divisional of application Ser. No. 13/047,680, filed Mar. 14, 2011, which is incorporated by reference in its entirety herein.

BACKGROUND OF INVENTION

1. Field of the Invention

Embodiments disclosed herein generally relate to a downhole wiper plug system and a method of using the downhole wiper plug system. Specifically, embodiments disclosed herein relate to a system of liner wiper plugs used to isolate cement from drilling fluids when pumping cement into the formation. More specifically, embodiments disclosed herein relate to a dual wiper plug system and method of cementing a liner in a borehole using the dual wiper plug system.

2. Background Art

After a borehole has been drilled into the earth, a string of steel casing or liner is lowered and set therein. One drillable shoe and possibly one drillable collar having an upwardly closing check valve are mounted on or near the lower end of the string to prevent back flow. After the liner has been suspended by a hanger apparatus near the lower end of a previously run casing string, cement slurry is pumped down the interior thereof and out into the borehole via the check valves where it flows up in the annulus outside the liner up to a desired level. The drilling mud that was standing in the well prior to cementing is displaced and circulated out of the well during the casing setting and cementing steps. When the cement has hardened, it seals off the annular space between the outside of the liner and the surrounding well bore wall and prevents migration of formation fluids therealong.

It is desirable to protect the cement slurry from contamination by the drilling mud as the slurry is being pumped into the well. The usual practice to protect the cement slurry is to place a first plug ahead of the cement column which provides a separation between the lower end of such column and the mud, and to place a second plug which performs the same function at the top of the column. Each plug typically has a series of upwardly facing elastomer cups whose outer edges engage the inner walls of the liner to provide sliding seals and wipers. When the first plug lands against a float shoe at the bottom of the liner, a passage is opened up through the float shoe which enables cement to be pumped into the annulus. Eventually the second plug lands against the first plug as the displacement is completed. The check valves in the float shoes prevent back flow of the cement into the casing or liner during the time that it takes for the cement to set up. During downward movement, the outer edges of the cups of the second plug wipe or scrape the cement off of the inner walls of the liner so that no deposits are left. Once the cement has hardened, the plugs and cement shoes can be drilled out.

Wiper plugs used in cementing liners have been designed such that cement slurry and other fluids could be pumped through a flow passage in the plug itself, which requires complicated valve systems to open and close this passage. This complexity has resulted in plug structures that may be difficult to drill out at the end of the cementing operation. The inclusion of such valve structures also has reduced the performance characteristics of such plugs, particularly when the liner hanger and wiper plug launching system are used on directional or horizontal sections of a well.

In conventional wiper plug systems, the first and second plugs are engaged with the liner with shear screws. When a predetermined pressure is applied to the first or second plug, the shear screws break and allow the first and/or second plug to continue downward within the liner. Such shear mechanisms may be prose to prematurely releasing (i.e., breaking) if the tool is impacted when run into the hole. If the first plug is prematurely released, the plug may not properly move along the liner or properly seat in a seat of the float shoe. Moreover, if the first plug improperly impacts or lands in the seat, the seat may be damaged or debris may block the check valve.

Accordingly, there exists a need for an efficient and reliable liner wiper system.

SUMMARY OF INVENTION

In one aspect, the embodiments disclosed herein relate to a dual wiper plug system having a first wiper including a first body having a first bore therethrough, and at least one wiper fin disposed around the body, a second wiper disposed axially above the first wiper, the second wiper including a second body having a second bore therethrough and a first shoulder formed on the inner surface of the second body, and at least one wiper fin disposed around the body, and a first collet ring coupled to the first wiper and including at least one collet finger extending axially upward, and a collet head disposed on an upper end of the collet finger and configured to engage the first shoulder of the second body.

In another aspect, embodiments disclosed herein relate to a method of using a dual wiper plug system, the method including running the dual wiper plug system coupled to a running tool into a well, the dual wiper plug system having a first wiper coupled to a second wiper with a first collet device, and a second wiper coupled to the running tool with a second collet device, securing the dual wiper plug system proximate an upper end of a liner, dropping a first pump down plug into the dual wiper plug system, decoupling the first wiper from the second wiper comprising disengaging the first collet device, dropping a second pump down plug into the dual wiper plug system, and decoupling the second wiper from the running tool comprising disengaging the second collet device.

In another aspect, embodiments disclosed herein relate to a landing collar including a housing, a first sleeve configured to receive a lead wiper plug, wherein the first sleeve comprises at least one bypass port, and at least one latching mechanism configured to couple the first sleeve to an inner wall of the housing, wherein the at least one latching mechanism comprises a c-ring coupled to the housing and a landing insert disposed within the c-ring.

Other aspects and advantages of the invention will be apparent from the following description and the appended claims.

DETAILED DESCRIPTION

Embodiments disclosed herein generally relate to a downhole wiper plug system and a method of using the downhole wiper plug system. Specifically, embodiments disclosed herein relate to a system of liner wiper plugs used to isolate cement from drilling fluids when pumping cement into the formation. More specifically, embodiments disclosed herein relate to a dual wiper plug system and method of cementing a liner in a borehole using the dual wiper plug system.

A liner wiper plug system in accordance with embodiments of the present disclosure is used to isolate cement from drilling fluids when cement is pumped into the formation through the drill string to cement a liner in place. A dual wiper plug system in accordance with embodiments disclosed herein has a first or lead wiper and a second or follow wiper. The lead wiper moves down the drill string in front of a volume of cement to prevent the cement from being contaminated by the drilling fluid. The follow wiper moves down the drill string behind the volume of cement to remove any excess cement from the inner wall of the liner and to provide a barrier between the cement and drill string fluid, thereby preventing contamination of the cement and/or drilling fluid.

Figure 1A:
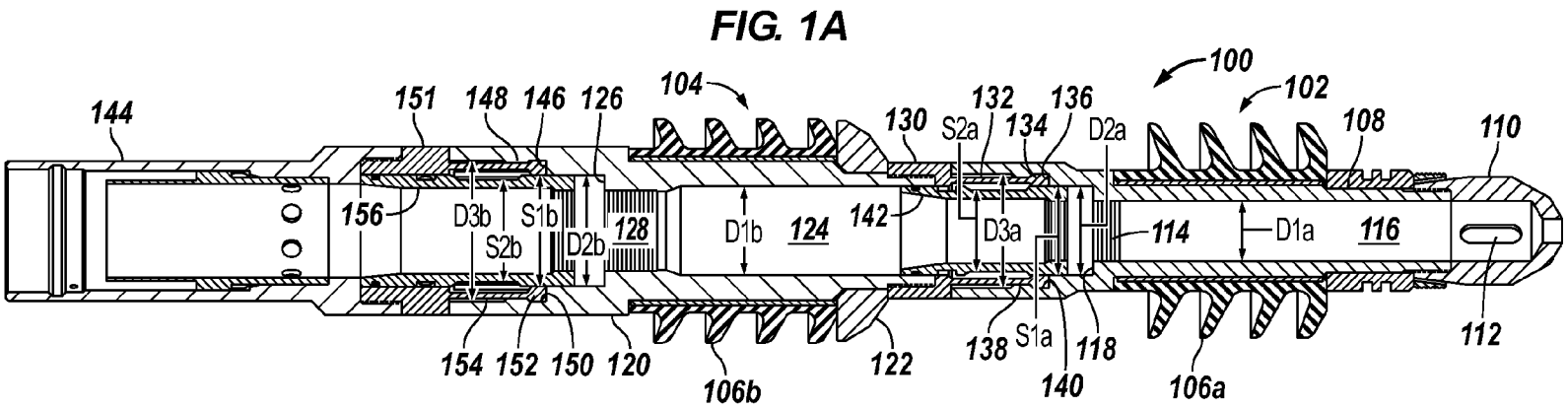
FIG. 1A is a cross-sectional view of a dual wiper plug system in accordance with embodiments disclosed herein.

Referring initially to FIG. 1A, a dual wiper plug system 100 in accordance with embodiments disclosed herein is shown. The dual wiper plug system 100 includes a lead wiper 102 and a follow wiper 104. Each of the lead wiper 102 and the follow wiper 104 include one or more wiping fins 106 disposed circumferentially around the body of the wiper 102, 104 and extending radially therefrom to contact and seal against an inner wall of a liner (not shown). The wiping fins 106 may be formed from an elastomeric material or any other know material in the art such that the wiping fins 106 are configured to flex or compress as the wiper 102, 104 is run through a liner or other tubular component having an inside diameter smaller than a maximum diameter of the wiping fins 106 in an expanded state.

The lead wiper 102 includes a tubular body 108 and a nose 110 disposed on a lower end of the body 108. The one or more wiping fins 106*a* are coupled to the body 108 by any means known in the art, for example, mechanical fasteners, co-molding, press fit, etc. The nose 110 includes one or more ports 112 to allow fluid flow from inside the body 108 to outside the body 108. The body 108 includes a bore 116 therethrough having a first diameter D1*a* and a second diameter D2*a*, such that the first diameter D1*a* is smaller than the second diameter D2*a*. As shown in FIG. 1A, the first diameter D1*a* of the bore is positioned axially below the second diameter D2*a*, thereby forming a shoulder 118. The inside surface of the body 108 includes a threaded portion 114. In one embodiment, the threaded portion 114 may be disposed proximate the upper end of the lead wiper 102, but in other embodiments, the threaded portion 114 may be disposed proximate the middle or lower end of the lead wiper 102. As shown, the threaded portion 114 may be formed in the first diameter D1*a* of the body 108. In one embodiment, the threaded portion 114 may be a ratchet thread.

The follow wiper 104 includes a tubular body 120 and a landing nose 122 disposed on a lower end of the tubular body 120. The one or more wiping fins 106*b* are coupled to the body 120 by any means known in the art, for example, mechanical fasteners, co-molding, press fit, etc. The body 120 of the follow wiper 104 includes a bore 124 therethrough having a first diameter D1*b* and a second diameter D2*b*, such that the first diameter D1*b* is smaller than the second diameter D2*b*. As shown in FIG. 1A, the first diameter D1*b* of the bore is positioned axially below the second diameter D2*b*, thereby forming a shoulder 126. The first diameter D1*b* of the follow wiper 104 may be larger than the first diameter D1*a* of the lead wiper 102. The inside surface of the body 120 of the follow wiper 104 includes a threaded portion 128. In one embodiment, the threaded portion 128 may be disposed proximate the upper end of the follow wiper 104, but in other embodiments, the threaded portion 128 may be disposed proximate the middle or lower end of the follow wiper 104. As shown, the threaded portion 128 may be formed in the first diameter D1*b* of the body 120. In one embodiment, the threaded portion 128 may be a ratchet thread.

The lead and follow wipers 102, 104 are initially run downhole on a lower end of a running tool 144 and positioned at the top of a liner (not shown) to be cemented. Thus, when the wiper plug system is initially run downhole, the lead wiper 102 is coupled to the follow wiper 104 and the follow wiper 104 is coupled to the lower end of the running tool 144. Before cement is pumped downhole, the lead wiper 102 may be released or separated from the follow wiper 104 and run downhole until it lands in a landing collar (not shown). After the cement is pumped downhole, the follow wiper 104 may be released or separated from the running tool 144 and run downhole until it lands in the lead wiper 102 positioned in the landing collar (not shown). The lead wiper 102 may be coupled with the follow wiper 104 and the follow wiper 104 may be coupled with the running tool 144 as discussed below.

A first collet ring 130 is coupled to the lower end of the body 120 of the follow wiper 104. The first collet ring 130 may be coupled to the body 120 by any means known in the art, for example, threaded connection, welding, press-fit, or mechanical fasteners, such as bolts, screws, or shear screws. The first collet ring 130 includes at least one collet finger 132 extending axially downward and configured to engage the body 108 of the lead wiper 102. One of ordinary skill in the art will appreciate that the first collet ring 130 may include a cylindrical ring having one or more collet fingers 132 extending therefrom or may include one or more collet fingers individually coupled to the follow wiper 104.

As shown, the bore 116 of the lead wiper 102 may include a third diameter D3*a* axially above the second diameter D2*a* and larger than the first and second diameters D1*a*, D2*a*. A second shoulder 136 is formed between the second diameter D2*a* and the third diameter D3*a*. An upset 138 may be formed on the third diameter D3*a* of the body 108, thereby forming a groove 140 between the upset 138 and the second shoulder 136. One of ordinary skill in the art will appreciate that the upset 138 may be a circumferential upset in the third diameter D3*a* of the bore 116 of the body 108 or may be one or more individual upsets disposed circumferentially around the third diameter D3*a* of the body 108. The groove 140 is configured to receive a collet head 134 of the collet finger 132, so as to couple the lead wiper 102 and the follow wiper 104. The collet head 134 includes an extension portion that extends radially outward from the collet finger 132, such that the extension portion engages the groove 140 of the lead wiper 102 body 108 and abuts the upset 138.

A first sleeve 142 is disposed within the upper end of the body 108 of the lead wiper 102. At least a portion of the first sleeve 142 may extend into the lower end of the follow wiper 104. An inside diameter of the first sleeve 142 is approximately equal to the first diameter D1*a* of the bore 116 of the lead wiper 102. The first sleeve 142 has a first outer diameter S1*a* and a second outer diameter S2*a*, wherein the second outer diameter S2*a* is smaller than the first outer diameter S1*a*. When the follow wiper 104 and the lead wiper 102 are coupled together (e.g., when the lead and follow wipers 102, 104 are run into the hole and positioned at the top of a liner) the first sleeve 142 may be disposed a selected axial distance above the shoulder 118 formed between the first and second diameters D1*a*, D2*a* of the bore 116 of the lead wiper 102. In this engaged or run-in position, the first outer diameter S1*a* of the first sleeve 142 contacts the inner surface of the collet head 134 of the at least one collet finger 132, thereby maintaining the collet head 134 in the groove 140 of the lead wiper 102 body 108. Contact between the collet head 134 and the upset 138 of the lead wiper 102 body 108 maintains engagement of the lead and follow wipers 102, 104.

A second collet ring 151 is coupled to the lower end of the running tool 144. The second collet ring 151 may be coupled to the running tool 144 by any means known in the art, for example, threaded connection, welding, press-fit, or mechanical fasteners, such as bolts, screws, or shear screws. The second collet ring 151 includes at least one collet finger 154 extending axially downward and configured to engage the body 120 of the follow wiper 104. One of ordinary skill in the art will appreciate that the second collet ring 151 may include a cylindrical ring having one or more collet fingers 154 extending therefrom or may include one or more collet fingers individually coupled to the running tool 144.

As shown, the bore 124 of the follow wiper 104 may include a third diameter D3*b* axially above the second diameter D2*b* and larger than the first and second diameters D1*b*, D2*b*. A second shoulder 146 is formed between the second diameter D2*b* and the third diameter D3*b*. An upset 148 may be formed on the third diameter D3*b* of the body 120, thereby forming a groove 150 between the upset 148 and the second shoulder 146. One of ordinary skill in the art will appreciate that the upset 148 may be a circumferential upset in the third diameter D3*b* of the bore 124 of the body 120 or may be one or more individual upsets disposed circumferentially around the third diameter D3*b* of the body 120. The groove 150 is configured to receive a collet head 152 of the collet finger 154, so as to couple the follow wiper 104 and the running tool 144. The collet head 152 includes an extension portion that extends radially outward from the collet finger 154, such that the extension portion engages the groove 150 of the follow wiper 104 body 120 and abuts the upset 148.

A second sleeve 156 is disposed within the upper end of the body 120 of the follow wiper 104. At least a portion of the second sleeve 156 may extend into the lower end of the running tool 144. An inside diameter of the second sleeve 156 is approximately equal to or less than the first diameter D1*b* of the bore 124 of the follow wiper 104. The second sleeve 156 has a first outer diameter S1*b* and a second outer diameter S2*b*, wherein the second outer diameter S2*b* is smaller than the first outer diameter S1*b*. When the follow wiper 104 and the running tool 144 are coupled together (e.g., when the lead and follow wipers 102, 104 are run into the hole and positioned at the top of a liner) the second sleeve 156 may be disposed a selected axial distance above the shoulder 126 formed between the first and second diameters D1*b*, D2*b* of the bore 124 of the follow wiper 104. In this engaged or run-in position, the first outer diameter S1*b* of the second sleeve 156 contacts the inner surface of the collet head 152 of the at least one collet finger 154, thereby maintaining the collet head in the groove 150 of the follow wiper 104 body 120. Contact between the collet head 152 and the upset 148 of the follow wiper 104 body 120 maintains engagement of the follow wiper 104 and the running tool 144.

Once the coupled lead and follow wipers 102, 104 are run downhole on the running tool 144 and positioned at the top of the liner to be cemented, the lead wiper 102 may be decoupled from the follow wiper 104 and run downhole. The lead wiper 102 is moved downhole by of a volume of cement pumped down into the bore of the liner behind the lead wiper 102 until the lead wiper 102 seats within a landing collar (not shown) positioned proximate a distal end of the liner (not shown).

Figure 1B:
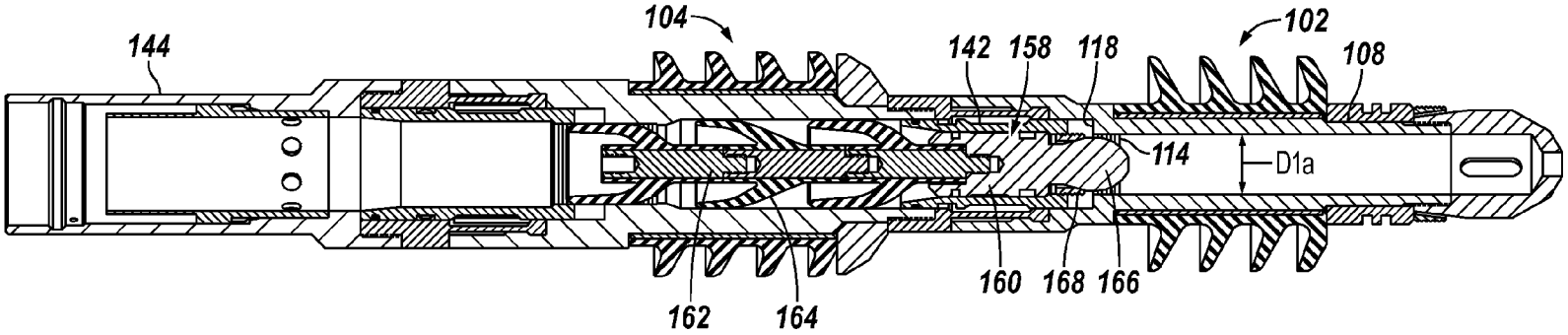
FIG. 1B is a cross-sectional view of the dual wiper plug system of FIG. 1A with a first pump down plug in accordance with embodiments disclosed herein.

To decouple the lead wiper 102 from the follow wiper 104, a first drill pipe pump down plug ("PDP") may be released from the surface into the drill string. As shown in FIG. 1B, the first PDP 158 includes a solid body 160 and a tail portion 162. The body 160 and the tail portion 162 of the PDP 158 may be separate components coupled together by any means known in the art, for example, by threaded engagement, press-fit, welding, etc., or may be integrally formed. One or more fins 164 are disposed on the tail portion 162 and may be formed from any material known in the art, for example, an elastomer. The fins 164 are configured to flex or compress when the PDP 158 is run into a tubular or component having an inner diameter smaller than a maximum diameter of the fins 164 in an expanded state. The body 160 includes a rounded nose portion 166 having an outer diameter approximately equal to or less than the first diameter D1*a* of bore 116 of the lead wiper 102. A split ring 168 may be disposed around the body 160 of the first PDP 158 proximate the nose portion 166. An outer surface of the split ring 168 may include a threaded portion. In one embodiment, the outer surface of the split ring 168 may include a ratchet thread configured to engage the threaded portion 114 disposed on the inside surface of the body 108 of the lead wiper 102. Additionally, an inside diameter of the first sleeve 142 may also include a corresponding thread, such that when the first PDP 158 is dropped in the bore 116 of the lead wiper 102, the first PDP 158 may be secured to both the body 108 and the sleeve 142. This threaded engagement may enhance the seal of the first PDP 158 within the lead wiper 102.

As shown, an inside diameter of the first sleeve 142 proximate the upper end of the first sleeve 142 is larger than the inside diameter of the first sleeve 142 proximate the lower end of the first sleeve 142. The inside diameter of the first sleeve 142 may gradually change from a first diameter to a smaller diameter {i.e., the inside surface of the first sleeve 142 may be sloped) or the first sleeve 142 may include a first diameter and a second diameter forming a shoulder therebetween. In one embodiment, the maximum outside diameter of the first PDP 158 is approximately equal to or greater than a minimum inside diameter of the first sleeve 142. As such, when the first PDP 158 is run downhole, the first PDP 158 becomes wedged within or engages the first sleeve 142. In this embodiment, the split ring 168 of the first PDP 158 is located such that at least a portion of the split ring 168 extends downwardly below a lower surface of the first sleeve 142.

Referring to both FIGS. 1A and 1B, hydraulic pressure applied behind the first PDP 158 by the pumped volume of cement (not shown) causes the first PDP 158 to move the first sleeve 142 axially downward until the first sleeve 142 engages the shoulder 118 of the body 108 of the lead wiper 102. As the first sleeve 142 moves axially downward, the first outer diameter S1*a* of the first sleeve 146 moves downward until it is no longer in contact engagement with the collet head 134 of the first collet ring 130. Accordingly, the second outer diameter S2*a* is moved downward and spaced radially next to the collet head 134. Because the second outer diameter S2*a* is smaller than the first outer diameter S1*a*, a gap is provided between the collet head 134 and the first sleeve 146. The split ring 168 of the first PDP 158 engages the threaded portion 114 of the body 108 of the lead wiper 102. In an embodiment where the threaded portion 114 is a ratchet thread and the split ring 168 includes a ratchet thread on the outer surface, the engaged ratchet threads securely couple the first PDP 158 to the lead wiper 102 and prevent the first PDP 158 from moving axially upward. The first PDP 158 seals the bore 116 of the lead wiper 102 through engagement with the first sleeve 146. Thus, as the hydraulic pressure of the volume of cement is continuously applied behind the first PDP 158, the at least one collet finger 132 may flex radially inward allowing the collet head 142 to engage the second outer diameter S2*a* of the first sleeve 146 and disengage from the groove 140 of the lead wiper 102 body 108, thereby decoupling the lead wiper 102 from the follow wiper 104.

Figure 1C:
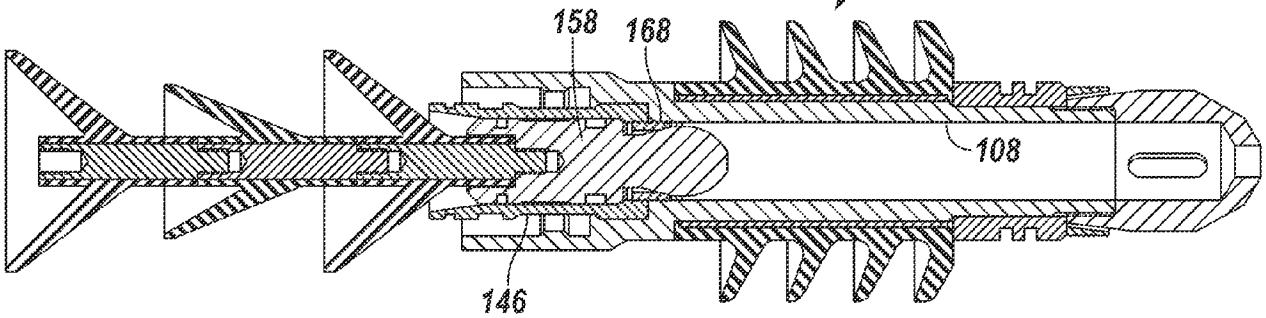
FIG. 1C is a cross-sectional view of a lead wiper released from the dual wiper plug system of FIG. 1A in accordance with embodiments disclosed herein.

FIG. 1C shows the lead wiper 102 disengaged from the follow wiper 104 (FIG. 1A) having the first PDP 158 coupled therein by the split ring 168 engaged with the inside surface of the body 108 and the outer diameter of the first PDP 158 engaged with the inside diameter of the first sleeve 146. The lead wiper 102 is then pumped downhole in front of the volume of cement, while the follow wiper 104 (FIG. 1A) remains coupled to the running tool 144 (FIG. 1A) at the top of the liner (not shown).

Figure 1D:
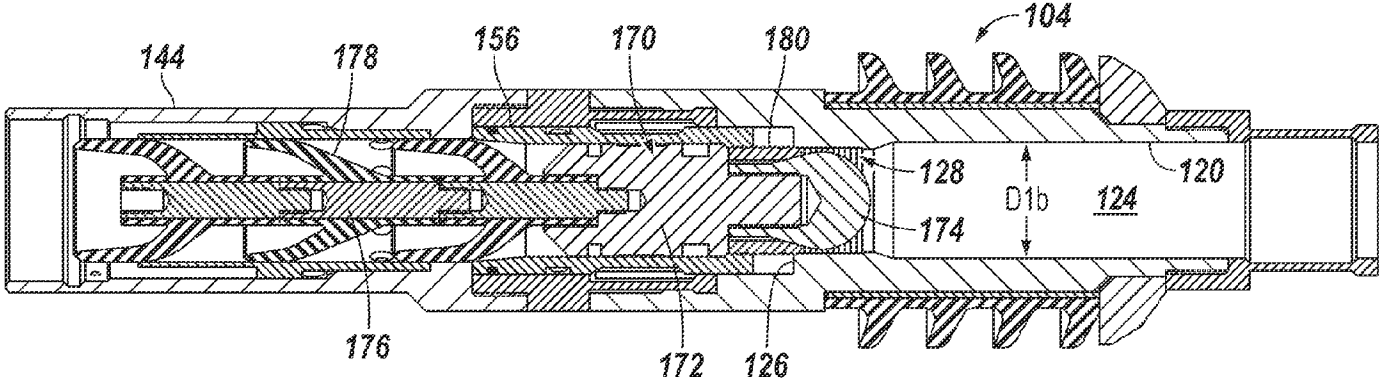
FIG. 1D is a cross-sectional view of the dual wiper plug system of FIG. 1A with a second pump down plug in accordance with embodiments disclosed herein.

FIG. 1D shows the follow wiper 104 coupled to the running tool 144 after the lead wiper 102 (FIG. 1C) has been decoupled from the follow wiper 104 and run downhole. Once a predetermined volume of cement has been pumped downhole for cementing a liner in place in a borehole, the follow wiper 104 may be decoupled from the running tool 144 and run downhole to remove any excess cement from the inside wall of the liner (not shown). To decouple the follow wiper 104 from the running tool 144, a second PDP 170 may be released from the surface after the volume of cement has been pumped downhole. Drilling fluid may be pumped behind the second PDP 170 to push the second PDP 170 down hole into the bore 124 of the follow wiper 104. A maximum outside diameter of the second PDP 170 is greater than the maximum outside diameter of the first PDP 168 (FIG. 1C). Further, the maximum outside diameter of the first PDP 168 is smaller than a minimum inside diameter of the second sleeve 156 disposed in follow wiper 104 or any inside diameter of the body 120 of the follow wiper 104. As will be described in more detail below, the maximum outside diameter of the second PDP 170 is greater than at least the minimum inside diameter of the second sleeve 156 disposed in the follow wiper 104.

As shown in FIG. 1D, the second PDP 170 includes a solid body 172 and a tail portion 176. The body 172 and the tail portion 176 of the second PDP 170 may be separate components coupled together by any means known in the art, for example, by threaded engagement, press-fit, welding, etc., or may be integrally formed. One or more fins 178 are disposed on the tail portion 176 and may be formed from any material known in the art, for example, an elastomer. The fins 178 are configured to flex or compress when the PDP 170 is run into a tubular or component having an inner diameter smaller than a maximum diameter of the fins 178 in an expanded state. The body 172 includes a rounded nose portion 174 having an outer diameter approximately equal to or less than the first diameter D1*b* of bore 124 of the follow wiper 104. A split ring 180 may be disposed around the body 172 of the second PDP 170 proximate the nose portion 174. An outer surface of the split ring 180 may include a threaded portion. In one embodiment, the outer surface of the split ring 180 may include a ratchet thread configured to engage the threaded portion 128 disposed on the inside surface of the body 120 of the follow wiper 104.

As shown, an inside diameter of the second sleeve 156 proximate the upper end of the second sleeve 156 is larger than the inside diameter of the second sleeve 156 proximate the lower end of the second sleeve 156. The inside diameter of the second sleeve 156 may gradually change from a first diameter to a smaller diameter (i.e., the inside surface of the second sleeve 156 may be sloped) or the second sleeve 156 may include a first diameter and a second diameter forming a shoulder therebetween. In one embodiment, the maximum outside diameter of the second PDP 170 is approximately equal to or greater than a minimum inside diameter of the second sleeve 156. As such, when the second PDP 170 is run downhole, the second PDP 170 becomes wedged within or engages the second sleeve 156. In this embodiment, the split ring 180 of the second PDP 170 is located such that at least a portion of the split ring 180 extends downwardly below a lower surface of the second sleeve 180.

Referring to both FIGS. 1A and 1D, hydraulic pressure applied behind the second PDP 170 by the pumped drill fluid (not shown) causes the second PDP 170 to move the second sleeve 156 axially downward until the second sleeve 156 engages the shoulder 126 of the body 120 of the follow wiper 104. As the second sleeve 156 moves axially downward, the first outer diameter S1*b* of the second sleeve 156 moves downward until it is no longer in contact engagement with the collet head 152 of the second collet ring 151. Accordingly, the second outer diameter S2*b* is moved downward and spaced radially next to the collet head 152. Because the second outer diameter S2*b* is smaller than the first outer diameter S1*b*, a gap is provided between the collet head 152 and the second sleeve 156. The split ring 180 of the second PDP 170 engages the threaded portion 128 of the body 120 of the follow wiper 104. In an embodiment where the threaded portion 128 is a ratchet thread and the split ring 180 includes a ratchet thread on the outer surface, the engaged ratchet threads securely couple the second PDP 170 to the follow wiper 104 and prevent the second PDP 170 from moving axially upward. Additionally, an inside diameter of the second 156 may also include a corresponding thread, such that when the second PDP 170 is dropped in the bore 124 of the follow wiper 104, the second PDP 170 may be secured to both the body 120 and the sleeve 156. This threaded engagement may enhance the seal of the second PDP 170 within the follow wiper 104. The second PDP 170 seals the bore 124 of the follow wiper 104 through engagement with the second sleeve 156. Thus, as the hydraulic pressure of the drill fluid is continuously applied behind the second PDP 170, the at least one collet finger 154 may flex radially inward allowing the collet head 152 to engage the second outer diameter S2*b* of the second sleeve 156 and disengage from the groove 150 of the follow wiper 104 body 120, thereby decoupling the follow wiper 104 from the running tool 144.

Figure 1E:
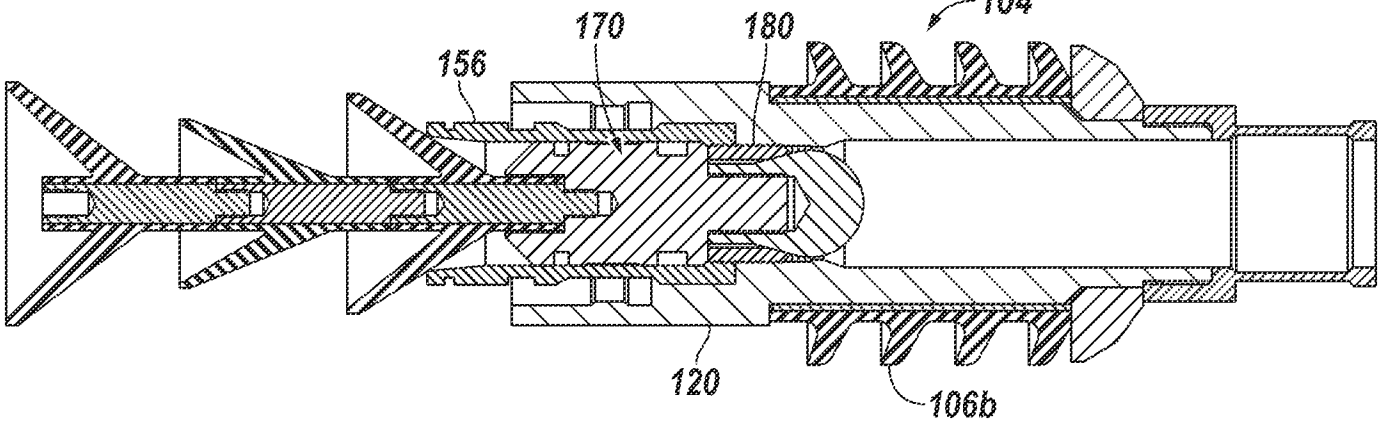
FIG. 1E is a cross-sectional view of a follow wiper released from the dual wiper plug system of FIG. 1A in accordance with embodiments disclosed herein.

FIG. 1E shows the follow wiper 104 disengaged from the running tool 144 (FIG. 1A) having the second PDP 170 coupled therein by the split ring 180 engaged with the inside surface of the body 120 and the outer diameter of the second PDP 170 engaged with the inside diameter of the second sleeve 156. The follow wiper 104 is then pumped downhole behind the volume of cement by the hydraulic force of drill fluid applied behind the follow wiper 104. As the follow wiper 104 moves downhole, the at least one wiping fin 106*b* contacts the inner wall of the liner and scrapes or removes any excess cement from the liner wall downward in front of the follow wiper 104.

FIGS. 2A-2F show another dual wiper plug system 200 in accordance with embodiments of the present disclosure. Dual wiper plug system 200 includes a lead wiper 202 and a follow wiper 204. Each of the lead wiper 202 and the follow wiper 204 include one or more wiping fins 206 disposed circumferentially around the body of the wiper 202, 204 and extending radially therefrom to contact and seal against an inner wall of a liner (not shown). The wiping fins 206 may be formed from an elastomeric material or any other know material in the art such that the wiping fins 206 are configured to flex or compress as the wiper is run through a liner or other tubular component having an inside diameter smaller than a maximum diameter of the wiping fins 206 in an expanded state.

Figure 2A:
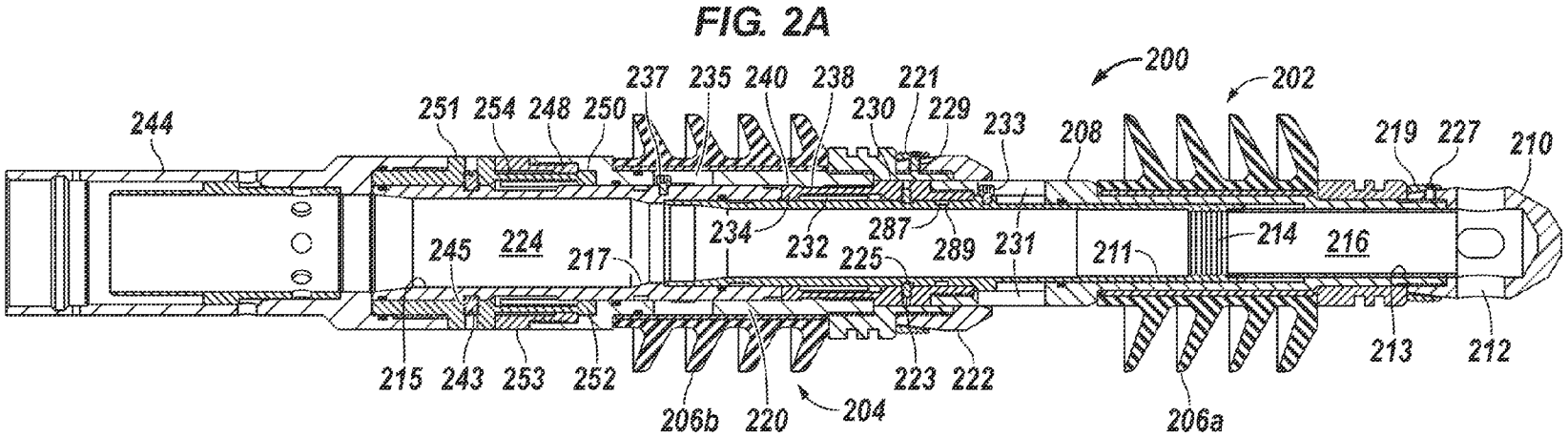
FIG. 2A is a cross-sectional view of a dual wiper plug system in accordance with embodiments disclosed herein.

FIG. 2A shows the lead wiper 202 coupled to the follow wiper 204 and the follow wiper coupled to a running tool 244 in a run-in position. The lead wiper 202 includes a tubular body 208 and a nose 210 disposed on a lower end of the body 208. The one or more wiping fins 206*a* are coupled to the body 208 by any means known in the art, for example, mechanical fasteners, co-molding, press fit, etc. The nose 210 includes one or more ports 212 to allow fluid flow from inside the body 208 to outside the body 208. A snap ring 219 may be disposed around the lead wiper 202 proximate the nose 210 and axially above the ports 212. The snap ring 219 may include a threaded outer surface configured to engage a corresponding threaded surface of the landing collar (not shown) to secure the lead wiper 202 in the landing collar (not shown). In one embodiment, the threaded outer surface of the snap ring 219 and the corresponding threaded surface of the landing collar (not shown) may be ratchet threads, so as to prevent the lead wiper 202 from moving axially upward when engaged. A bolt 227 or a key may be disposed in the snap ring 219 and configured to engage the snap ring 219 to the lead wiper 202 to prevent rotation of the lead wiper 202 and components of the lead wiper 202 when the lead wiper 202 is milled up after completion of the cementing process.

The body 208 includes a bore 216 therethrough. The lead wiper 202 includes at least one sleeve 211 disposed in the bore 216. The at least one sleeve 211 includes a threaded portion 214 disposed on the inner surface of the sleeve 211. In one embodiment, the threaded portion 214 may be a ratchet thread. In certain embodiments, the lead wiper 202 may include a first sleeve 211 and a second sleeve 213 coupled to the first sleeve 211, wherein a threaded portion 214 may be disposed on the inner surface of one of the first sleeve 211 and the second sleeve 213. As shown, the second sleeve 213 may be disposed axially below the first sleeve 211. In the run-in position, the first and second sleeves 211, 213 are positioned axially above the ports 212, such that the ports 212 are open. In one embodiment, the threaded portion 214 may be disposed proximate the upper end of the lead wiper 202, but in other embodiments, the threaded portion 214 may be disposed proximate the middle or lower end of the lead wiper 202.

One or more axial slots 231 may be formed in the body 208 of the lead wiper 202 configured to engage one or more anti-rotation devices 233 coupled to the first sleeve 211. The anti-rotation devices 233 may include a bolt or a key configured to fit within the axial slots 231 and prevent rotation of the first sleeve 211 when the lead wiper 202 and components of the lead wiper 202 are milled up after completion of the cementing process. The anti-rotation devices 233 are be configured to move axially within the one or more axial slots 231 when the first sleeve 211 shirts axially downward, but are prevented from rotating. Preventing rotation of the components of the lead wiper 202 during milling up may provide a quicker, more efficient milling process. Similarly, one or more slots 235 may be formed in the body 220 of the follow wiper 204 configured to engage one or more anti-rotation devices 237 coupled to the sleeve 215 of the follow wiper 204. The anti-rotation devices 237 may include a bolt or a key configured to fit within the slots 235 and prevent rotation of the sleeve 215 when the follow wiper 204 and the components of the follow wiper 204 are milled up.

Figure 4:
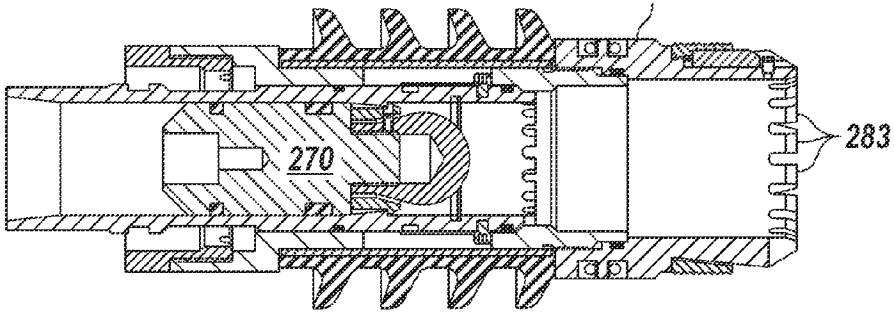
FIG. 4 is a cross-sectional view of a follow wiper in accordance with embodiments disclosed herein.

The follow wiper 204 includes a tubular body 220 and a landing nose 222 disposed on a lower end of the tubular body 220. In one embodiment, a lower end of the landing nose 222 may include a plurality of castellations 283, as shown in FIG. 4. The castellations 283 are configured to provide quicker and more efficient milling up of the follow wiper 204 after landing in the landing collar (not shown). As shown in FIG. 2A, the one or more wiping fins 206*b* are coupled to the body 220 by any means known in the art, for example, mechanical fasteners, co-molding, press fit, etc. A snap ring 221 may be disposed around the follow wiper 204 proximate the landing nose 222. The snap ring 221 may include a threaded outer surface configured to engage a corresponding threaded surface of the landing collar (not shown) to secure the follow wiper 204 in the landing collar (not shown). In one embodiment, the threaded outer surface of the snap ring 221 and the corresponding threaded surface of the landing collar (not shown) may be ratchet threads, so as to prevent the follow wiper 204 from moving axially upward when engaged. A bolt 229 or a key may be disposed in the snap ring 221 and configured to engage the snap ring 221 to the follow wiper 204 to prevent rotation of the follow wiper 204 and components of the follow wiper 204 when the follow wiper 204 is milled up after completion of the cementing process.

The body 220 of the follow wiper 204 includes a bore 224 therethrough. The follow wiper 204 includes a sleeve 215 disposed in the bore 224. The sleeve 215 includes an internal shoulder 217, such that an inside diameter of the sleeve 215 proximate the upper end of the shoulder 217 is larger than an inside diameter of the sleeve 215 proximate the lower end of the shoulder 217. The shoulder may be sloped or may be formed as a right angle. As shown, the lower end of the sleeve 215 may be configured to receive the upper end of the first sleeve 211 of the lead wiper 202 within the bore 224.

A first collet ring 230 is coupled to the upper end of the body 208 of the lead wiper 202. The first collet ring 230 may be coupled to the body 220 by any means known in the art, for example, threaded connection, welding, press-fit, or mechanical fasteners, such as bolts, screws, or shear screws. The first collet ring 230 includes at least one collet finger 232 extending axially upward and configured to engage the body 220 of the follow wiper 204. One of ordinary skill in the art will appreciate that the first collet ring 230 may include a cylindrical ring having one or more collet fingers 232 extending therefrom or may include one or more collet fingers individually coupled to the lead wiper 202. At least one shear screw 223 may be engaged with the first collet ring 230 and extend radially inward to engage a groove 225 formed in an outer surface of the first sleeve 211.

The one or more collet fingers 232 each include a collet head 234 configured to engage a groove 240 formed on the inner surface of the body 220, so as to couple the lead wiper 202 and the follow wiper 204. The collet head 234 includes an extension portion that extends radially outward from the collet finger 232, such that the extension portion engages the groove 234 of the follow wiper 204 body 220 and abuts an upset 238 formed on the inner surface of the body 220 axially below the groove 240.

When the follow wiper 204 and the lead wiper 202 are coupled together (e.g., when the lead and follow wipers 202, 204 are run into the hole and positioned at the top of a liner) an outer diameter of the first sleeve 211 contacts the inner surface of the collet head 234 of the at least one collet finger 232, thereby maintaining the collet head 234 in the groove 240 of the follow wiper 204 body 220. Contact between the collet head 234 and the upset 238 of the follow wiper 204 body 220 maintains engagement of the lead and follow wipers 202, 204.

A second collet ring 251 is coupled to the lower end of the running tool 244. The second collet ring 251 may be coupled to the running tool 244 by any means known in the art, for example, threaded connection, welding, press-fit, or mechanical fasteners, such as bolts, screws, or shear screws. The second collet ring 251 includes at least one collet finger 254 extending axially downward and configured to engage the body 220 of the follow wiper 204. One of ordinary skill in the art will appreciate that the second collet ring 251 may include a cylindrical ring having one or more collet fingers 254 extending therefrom or may include one or more collet fingers 254 individually coupled to the running tool 244. At least one shear screw 243 may be engaged with the second collet ring 251 and extend radially inward to engage a groove 245 formed in an outer surface of the sleeve 215.

The one or more collet fingers 254 each include a collet head 252 configured to engage a groove 250 formed on the inner surface of the body 220, so as to couple the follow wiper 204 to the running tool 244. The collet head 252 includes an extension portion that extends radially outward from the collet finger 254, such that the extension portion engages the groove 250 of the follow wiper 204 body 220 and abuts an upset 248. The upset 248 may be formed on the inner surface of the body 220 axially above the groove 250 or the upset 248 may be formed by a secondary ring 253 coupled to the body 220 of the follow wiper 204.

When the follow wiper 204 and the running tool 244 are coupled together (e.g., when the lead and follow wipers 202, 204 are run into the hole and positioned at the top of a liner) an outer diameter of the sleeve 215 of the follow wiper 204 contacts the inner surface of the collet head 252 of the at least one collet finger 254, thereby maintaining the collet head 252 in the groove 250 of the follow wiper 202 body 220. Contact between the collet head 252 and the upset 248 of the follow wiper 202 body 220 maintains engagement of the follow wiper 204 and the running tool 244.

Figure 2B:
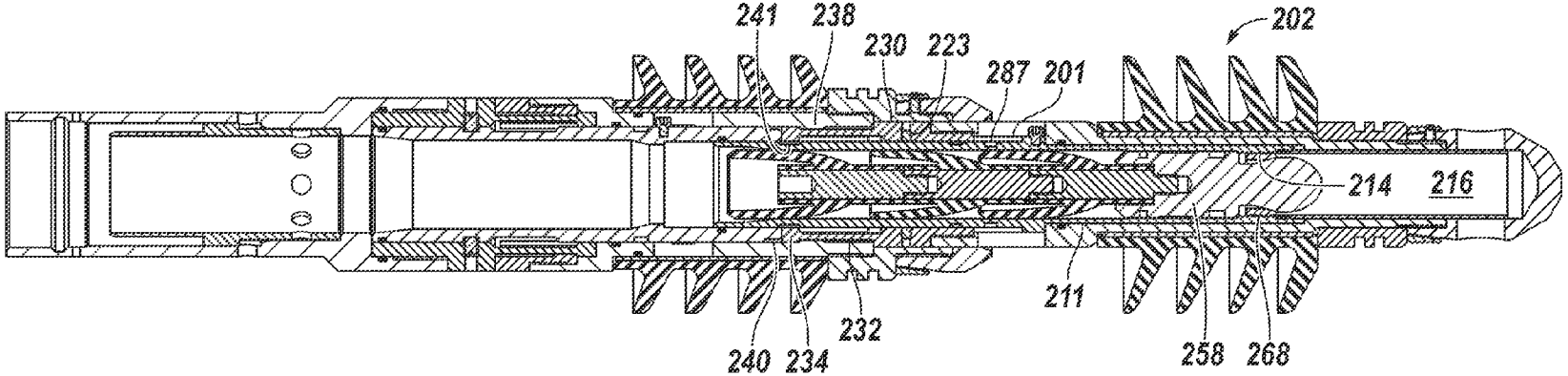
FIG. 2B is a cross-sectional view of the dual wiper plug system of FIG. 2A with a first pump down plug in accordance with embodiments disclosed herein.

To decouple the lead wiper 202 from the follow wiper 204, a first PDP 258 may be released from the surface into the drill string. As shown in FIG. 2B, the first PDP 258 may be configured similar to the first PDP 158 described above with reference to FIG. 1B. When the first PDP 258 is run downhole, the first PDP 258 becomes engaged with the first sleeve 211 of the lead wiper 202. In this embodiment, a split ring 268 of the first PDP 258 engages the threaded portion 214 disposed on the inner surface of the sleeve 211 to secure the first PDP 258 within the lead wiper 202 and seal the bore 216 of the lead wiper 202. An outer surface of the split ring 268 may include a ratchet thread and the threaded portion 214 of the sleeve 211 may be a corresponding ratchet thread, such that engagement of the threaded portions provides locking engagement of the first PDP 258 with the lead wiper 202 that prevents the first PDP 258 from moving axially upward.

Referring to both FIGS. 2A and 2B, hydraulic pressure applied behind the first PDP 258 by the pumped volume of cement (not shown) causes the first PDP 258 to move the first sleeve 211 axially downward, shearing the shear pins 223, until the second sleeve 213 engages or abuts an inside surface of the nose 210 of the lead wiper 102. When the second sleeve 213 engages the nose 210, the ports 212 are closed by the sleeve 213. The first sleeve 211 may include a snap ring 287 disposed in a circumferential groove 289 formed in an outer surface of the first sleeve 211. The snap ring 287 and circumferential groove 289 may be located axially below the groove 225 formed in the first sleeve 211 configured to receive at least one shear screw 223. The snap ring 287 may be biased radially outward. In the run-in position, the snap ring 287 is compressed within the groove 289 by contact engagement with the inner surface of the first collet ring 230. As the first sleeve 211 moves axially downward, the snap ring 287 may radially align with a groove or shoulder 201 on the inside diameter of the body 208 of the lead wiper 202, thereby allowing the snap ring 287 to expand radially outward to secure the first sleeve 211 to the body 208.

The first sleeve 211 also includes a groove 241 or a reduced outer diameter portion. When the tool is run-in, the groove 241 is spaced axially above the collet head 234 a distance approximately equal to the distance between a lower surface of the second sleeve 213 and the inside surface of the nose 210. Thus, when the first sleeve 211 moves axially downward, the groove 241 moves into radial alignment with the collet head 234 of the first collet ring 230. As the hydraulic pressure of the volume of cement is continuously applied behind the first PDP 258, the at least one collet finger 232 may flex radially inward allowing the collet head 234 to engage the groove 241 of the first sleeve 211 and disengage from the groove 240 and the upset 238 of the lead wiper 202 body 208, thereby decoupling the lead wiper 202 from the follow wiper 204.

Figure 2C:
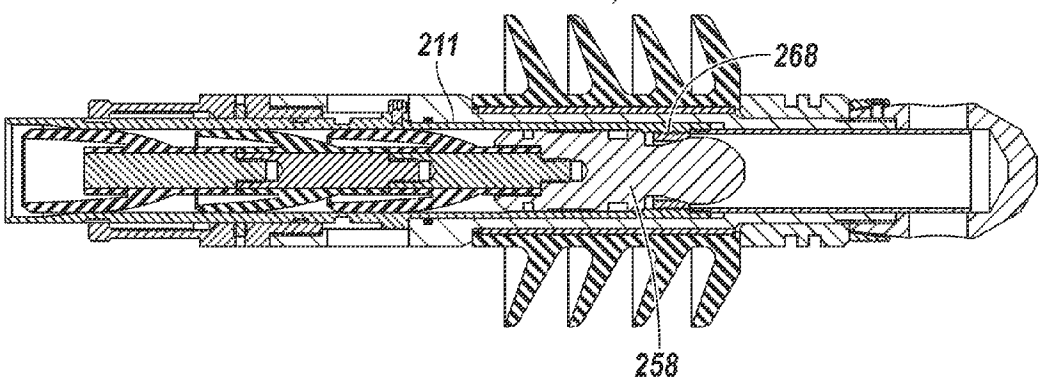
FIG. 2C is a cross-sectional view of a lead wiper released from the dual wiper plug system of FIG. 2A in accordance with embodiments disclosed herein.

FIG. 2C shows the lead wiper 202 disengaged from the follow wiper 204 (FIG. 2A) having the first PDP 258 coupled therein by the split ring 268 engaged with the inside surface of the sleeve 211. The lead wiper 202 is then pumped downhole in front of the volume of cement, while the follow wiper 204 (FIG. 2A) remains coupled to the running tool 244 (FIG. 2A) at the top of the liner (not shown).

Figure 2D:
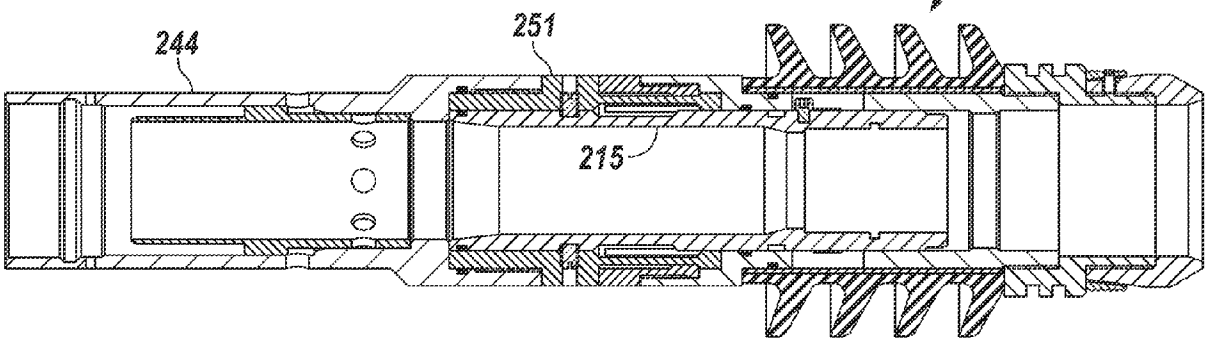
FIG. 2D is a cross-sectional view of the dual wiper plug system of FIG. 2A after a lead wiper has been released in accordance with embodiments disclosed herein.
Figure 2E:
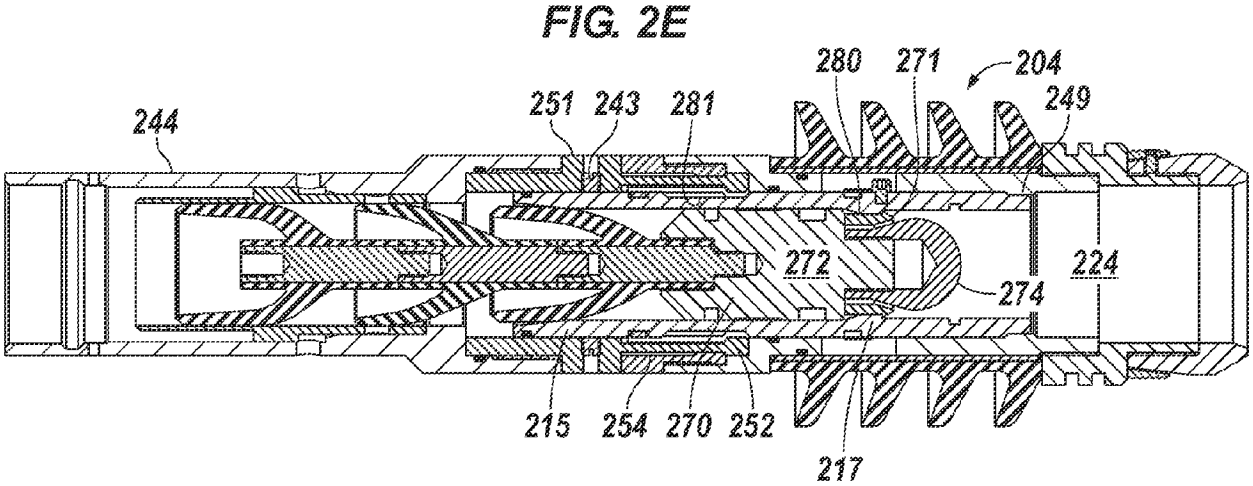
FIG. 2E is a cross-sectional view of the dual wiper plug system of FIG. 2A with a second pump down plug in accordance with embodiments disclosed herein.

FIGS. 2D and 2E show the follow wiper 204 coupled to the running tool 244 after the lead wiper 202 (FIG. 2C) has been decoupled from the follow wiper 204 and run downhole. Once a predetermined volume of cement has been pumped downhole for cementing a liner in place in a borehole, the follow wiper 204 may be decoupled from the running tool 244 and run downhole to remove any excess cement from the inside wall of the liner (not shown). To decouple the follow wiper 204 from the running tool 244, a second PDP 270 may be released from the surface after the volume of cement has been pumped downhole. Drilling fluid may be pumped behind the second PDP 270 to push the second PDP 270 down hole into the bore 224 of the follow wiper 204. A split ring 280 is disposed around the body 272 of the second PDP 270 proximate the nose portion 274. The split ring 280 may include a latching mechanism 271, for example a c-ring with a lip, a collet finger, or latching dog, configured to engage the shoulder 217 of the sleeve 215 of the follow wiper 204. The latching mechanism 271 may include an axial portion and an extension portion such that the axial portion is configured to flex radially inward as the extension portion passes through the shoulder 217 and radially outward after the extension portion has passed through the shoulder 217. The extension portion may then be engaged with the shoulder 217 such that the second PDP 270 may not move axially upward. In other embodiments, an outer surface of the split ring 280 may include a threaded portion. In one embodiment, the outer surface of the split ring 280 may include a ratchet thread configured to engage a threaded portion (not shown) disposed on the inside surface of the body 220 of the follow wiper 204.

As shown in FIG. 2E, the second PDP 270 is similar to the second PDP 170 described above with reference to FIG. 1. The outside diameter of the body 272 of the PDP 270 is approximately equal to or slightly less than the inside diameter of the sleeve 215. When the second PDP 270 is run downhole, the second PDP 270 engages the shoulder 217 of the sleeve 215, thereby sealing the bore 224 of the follow wiper 204.

Referring to both FIGS. 2A and 2E, hydraulic pressure applied behind the engaged second PDP 270 by the pumped drill fluid (not shown) causes the second PDP 270 to move the sleeve 215 axially downward until the sleeve 215 engages a shoulder 249 formed on the inside of the body 220 of the follow wiper 204. As the sleeve 215 moves, the shear screws 243 are sheared. The first sleeve 215 includes a groove 281 or a reduced outer diameter portion. When the tool is run-in, the groove 281 is spaced axially above the collet head 252 a distance approximately equal to the distance between a lower surface of the sleeve 215 and the shoulder 249. Thus, when the sleeve 215 moves axially downward, the groove 281 moves into radial alignment with the collet head 252 of the second collet ring 251. As the hydraulic pressure of the volume of drill fluid is continuously applied behind the second PDP 270, the at least one collet finger 254 may flex radially inward allowing the collet head 252 to engage the groove 281 of the sleeve 215 and disengage from the groove 250 and the upset 248 of the follow wiper 204 body 220, thereby decoupling the follow wiper 204 from the running tool 244.

Figure 2F:
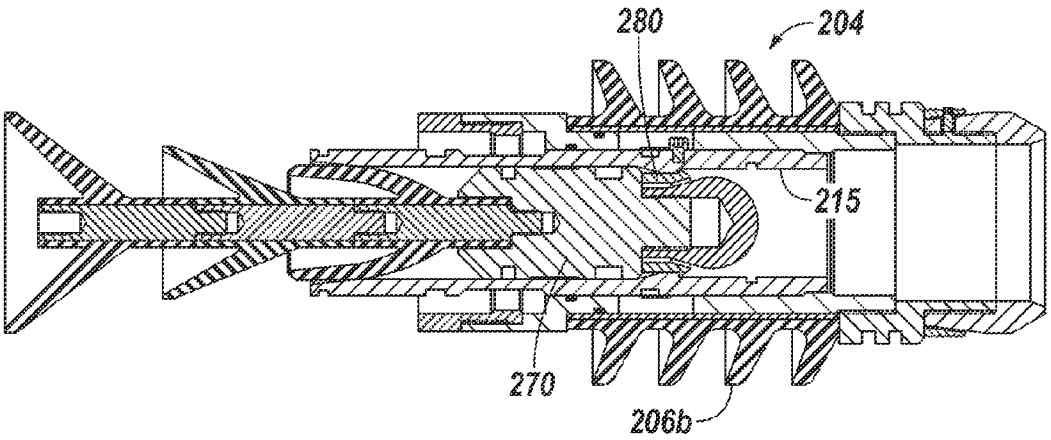
FIG. 2F is a cross-sectional view of a follow wiper released from the dual wiper plug system of FIG. 2A in accordance with embodiments disclosed herein.

FIG. 2F shows the follow wiper 204 disengaged from the running tool 244 (FIG. 2E) having the second PDP 270 coupled therein by the split ring 280 engaged with the inside surface of the sleeve 215. The follow wiper 204 is then pumped downhole behind the volume of cement by the hydraulic force of drilling fluid applied behind the follow wiper 204. As the follow wiper 204 moves downhole, the at least one wiping fin 206*b* contacts the inner wall of the liner and scrapes or removes any excess cement from the liner wall downward in front of the follow wiper 204.

In the event that the second PDP 270 (FIG. 2E) is mistakenly dropped into the well before the first PDP 258 (FIG. 2A), the dual plug system 200 disclosed herein is configured to prevent premature decoupling of the follow wiper 204 from the running tool 244 if the lead wiper 202 is still coupled to the follow wiper 204. That is, the follow wiper 204 is prevented from decoupling from the dual plug system 200 if the lead wiper 202 has not yet been decoupled from the dual plug system 200.

Figure 3:
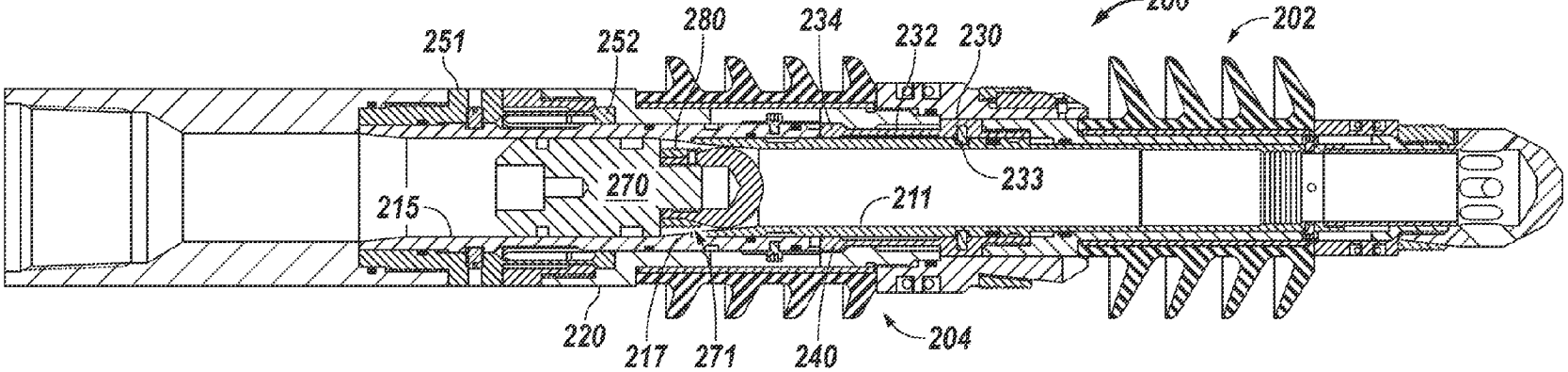
FIG. 3 is a cross-sectional view of a dual wiper plug system with a second pump down plug prematurely dropped therein in accordance with embodiments disclosed herein.

As shown in FIG. 3, where like reference characters represent like parts, in the event that the second PDP 270 is mistakenly dropped before the first PDP 258 (FIG. 2A), the first PDP 270 runs into the sleeve 215 of the follow wiper 204 until the outer diameter of the PDP 270 contacts the internal shoulder 217 of the follow wiper 204. Because the lead wiper 202 is still coupled to the follow wiper 204, the upper surface of the first sleeve 211 of the lead wiper 202 abuts a lower surface of the shoulder 217 of the follow wiper 204 sleeve 215. As such, the latching mechanism 271 of the split ring 280 of the second PDP 270 does not fully engage the internal shoulder 217 of the sleeve 215. The internal shoulder 217 provides a load bearing surface on the sleeve 215 of the follow wiper 204 as pressure is applied from above the second PDP 270, thereby preventing pressure from being applied to the first sleeve 211 of the lead wiper 202. Because pressure is not applied to the first sleeve 211 of the lead wiper 202, the shear screws 223 securing the first sleeve 211 to the first collet ring 230 remain intact and the first sleeve 211 does not move axially downward. Additionally, the collet head 234 of the first collet ring 230 remains engaged with the groove 240 of the body 220 of the follow wiper 204, thereby preventing the lead wiper 202 from being released. As shown in FIG. 3, because the sleeve 215 of the follow wiper 204 initially abuts the upper surface of the collet head 234, and because the collet head 234 remains fully engaged with the body 220 of the follow wiper 204, the sleeve 215 is prevented from moving axially downward. Because the sleeve 215 is prevented from moving axially downward, the collet head 252 of the second collet ring 251 remains engaged with the body 220 of the follow wiper 204, thereby preventing the follow wiper 204 from decoupling from the running tool 244. In this embodiment, another downhole tool, for example a fishing tool, may be run inside the running tool 244 and latched onto the second PDP 270 to retrieve the second PDP 270 from the dual plug system 200. Subsequently, the first PDP 258 (FIG. 2A) may be run downhole to decouple the lead wiper 202 from the follow wiper 204, as described in detail above with respect to FIG. 2. Alternatively, the entire dual plug system 200 may be removed from the well and the second PDP 270 removed from the dual plug system 200 at the surface. The dual plug system 200 may then be run back into the well and used to cementer the liner (not shown) as described above with reference to FIG. 2.

Figure 5:
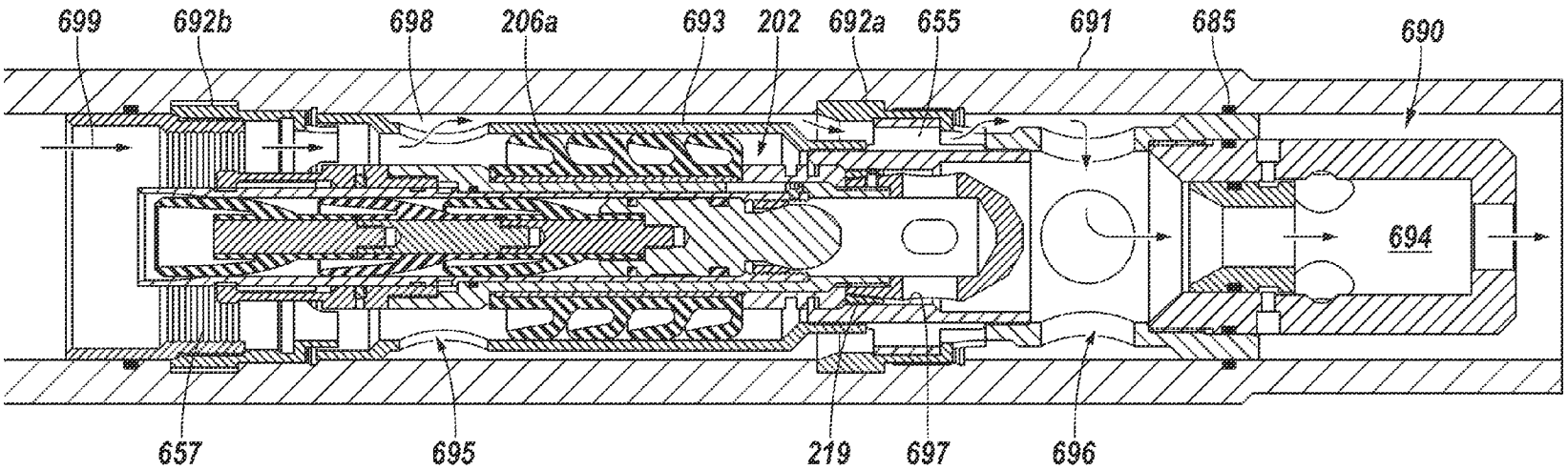
FIG. 5 is a cross-sectional view of a lead wiper landed in a landing collar disposed below a liner in accordance with embodiments disclosed herein.

Referring now to FIG. 5, a landing collar 690 disposed in a housing 691 at a lower end of a liner (not independently illustrated) is shown. The landing collar 690 is coupled to the housing 691 by at least one latching mechanism 692. The latching mechanism 692 may be any device used for securing a tubular body within a housing known in the art, for example, locking dogs, ratchet split rings, anchoring devices, etc. One or more seals 685 may be disposed around the landing collar 690 and configured to seal between the landing collar 690 and the housing 691. The landing collar 690 may include one or more tubular bodies 693 having a central bore 694 therethrough. The landing collar 690 includes at least one upper radial port 695 disposed proximate the upper end of the landing collar 690 and at least one lower radial port 696 disposed proximate a lower end of the landing collar 690. The landing collar 690 is configured to receive the lead wiper 202 after it has been released from the dual plug system 200 (FIG. 2A) at the top of the liner.

When the lead wiper 202 is decoupled from the dual plug system 200 (FIG. 2A), as described above, the fluid pressure of the volume of cement behind the lead wiper 202 moves the lead wiper 202 axially downward to the lower end of the liner and seats the lead wiper 202 in the landing collar 290. The threaded outer surface of the snap ring 219 disposed around the lead wiper 202 engages a corresponding threaded surface 697 of the landing collar 690 to secure the lead wiper 202 in the landing collar 690. In one embodiment, the threaded outer surface of the snap ring 219 and the corresponding threaded surface 697 of the landing collar 690 may be ratchet threads, so as to prevent the lead wiper 202 from moving axially upward when engaged. As shown, when the lead wiper 202 moves into an upper end of the tubular body 693 of the landing collar 690, the at least one wiping fin 206*a* is flexed or compressed within the tubular body 693. As shown, at least a portion of an outside diameter of the landing collar 690 is less than the inside diameter of the liner, thereby providing an annulus 698. As shown, the annulus 698 may be disposed between first latching mechanism 692*a* and second latching mechanism 692*b*. Additionally, the at least one upper radial port 695 of the landing collar 690 radially aligns with the annulus 698.

Once the lead wiper 202 is seated and engaged within the landing collar 690, cement may flow around the lead wiper to cement the outside diameter of the liner in place. The cement flows around the lead wiper 202 as indicated by arrow 699 and as described below. When the lead wiper 202 seats within the landing collar 690, the lead wiper 202 is disposed axially above the at least one lower radial port 696 and the compressed wiping fins 206*a* are disposed axially below the at least one upper radial port 695. Specifically, the volume of cement behind the lead wiper 202 flows from behind the compressed wiping fins 206*a* through the at least one upper radial port 695 into the annulus 698. The cement then flows axially downward in the annulus 698 and through axial openings 655 of the first latching mechanism 692*a*. The cement may then flow radially inward through the at least one lower radial port 696 back into the bore 694 of the landing collar 690. The landing collar thereby provides a bypass assembly in which the cement may flow around the lead collar 202 seated within the landing collar 690. The cement may then be pumped upward between the liner and the formation (not shown) or other tubular (not shown) and allowed to cure.

Figure 6:
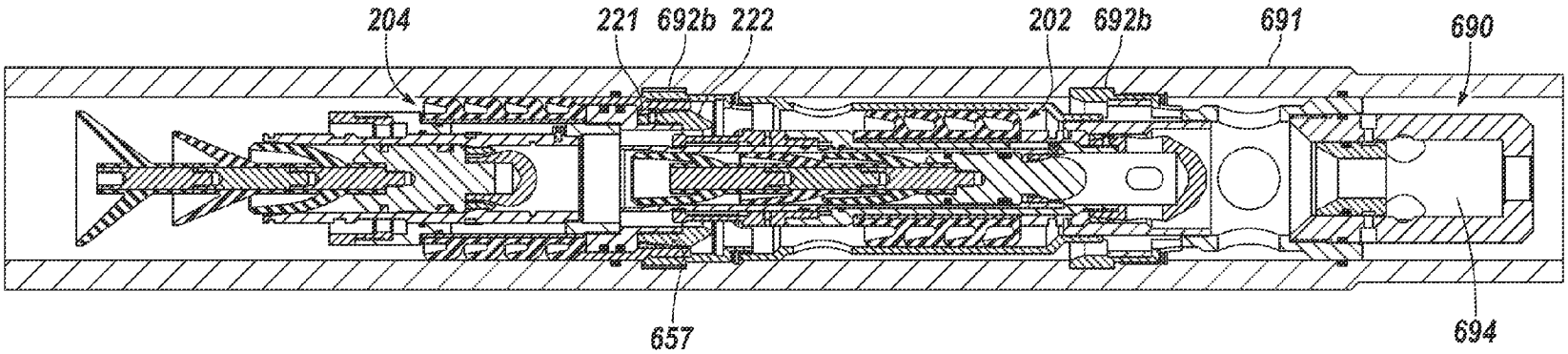
FIG. 6 is a cross-sectional view of a follow wiper and a lead wiper landed in a landing collar below a liner in accordance with embodiments disclosed herein.

Referring to FIG. 6, once the volume of cement has been pumped around the lead wiper 202 seated within the landing collar 690, the follow wiper 204 lands within the upper end of the landing collar 690 above the lead wiper 202. The snap ring 221 disposed around the follow wiper 204 proximate the landing nose 222 engages an inside surface of the upper end of the landing collar 690. As shown, the snap ring 221 may include a threaded outer surface configured to engage a corresponding threaded surface 657 of the landing collar 690 to secure the follow wiper 204 in the landing collar 690. In one embodiment, the threaded outer surface of the snap ring 221 and the corresponding threaded surface 657 of the landing collar 690 may be ratchet threads, so as to prevent the follow wiper 204 from moving axially upward when engaged. The latched follow wiper 204 seals the bore 694 of the landing collar 690 to prevent the cement from re-entering the drill string (not shown).

Figure 7A:
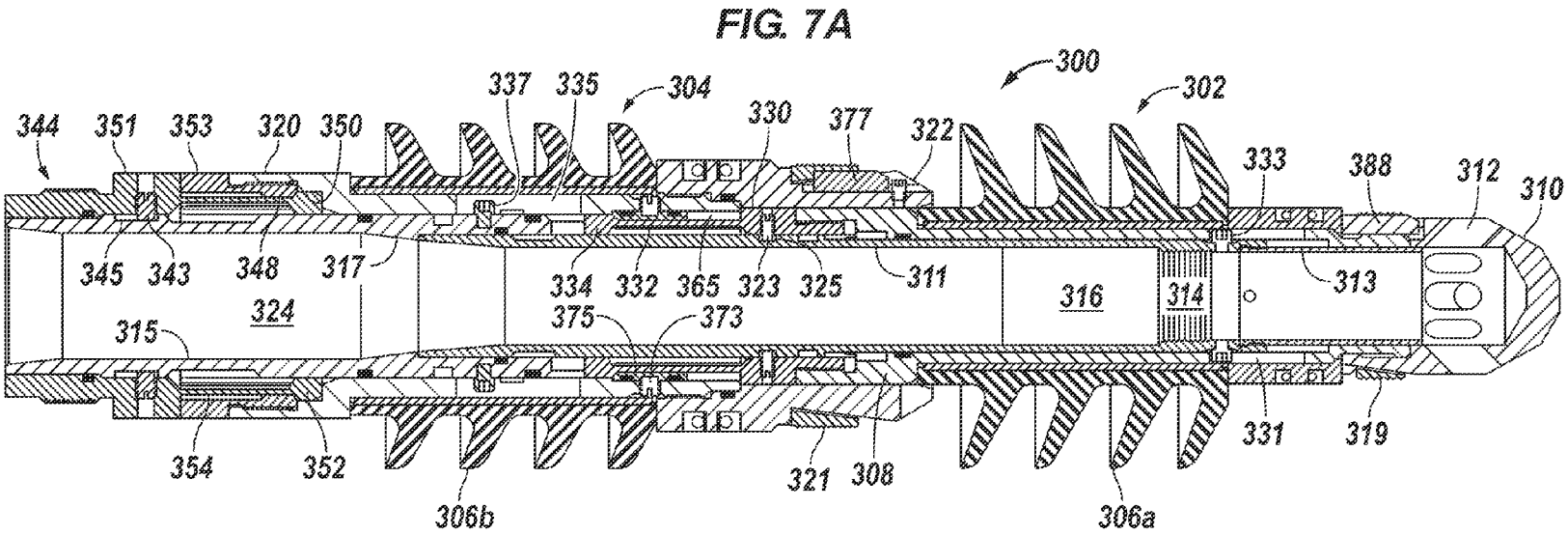
FIG. 7A is a cross-sectional view of a dual wiper plug system in accordance with embodiments disclosed herein.

Referring now to FIG. 7A, a dual wiper plug system 300 in accordance with embodiments of the present disclosure. Dual wiper plug system 300 includes a lead wiper 302 and a follow wiper 304. Each of the lead wiper 302 and the follow wiper 304 include one or more wiping fins 306 disposed circumferentially around the body of the wiper 302, 304 and extending radially therefrom to contact and seal against an inner wall of a liner (not shown). The wiping fins 306 may be formed from an elastomeric material or any other know material in the art such that the wiping fins 306 are configured to flex or compress as the wiper is run through a liner or other tubular component having an inside diameter smaller than a maximum diameter of the wiping fins 306 in an expanded state.

FIG. 7A shows the lead wiper 302 coupled to the follow wiper 304 and the follow wiper coupled to a running tool 344 in a run-in position. The lead wiper 302 includes a tubular body 308 and a nose 310 disposed on a lower end of the body 308. The one or more wiping fins 306*a* are coupled to the body 308 by any means known in the art, for example, mechanical fasteners, co-molding, press fit, etc. The nose 310 includes one or more ports 312 to allow fluid flow from inside the body 308 to outside the body 308. A snap ring 319 may be disposed around the lead wiper 302 proximate the nose 310 and axially above the ports 312. The snap ring 319 may include a threaded outer surface configured to engage a corresponding threaded surface of the landing collar (not shown) to secure the lead wiper 302 in the landing collar (not shown). In one embodiment, the threaded outer surface of the snap ring 319 and the corresponding threaded surface of the landing collar (not shown) may be ratchet threads, so as to prevent the lead wiper 302 from moving axially upward when engaged. A key 388 or bolt may be disposed in the snap ring 319 and configured to engage the snap ring 319 to the lead wiper 302 to prevent rotation of the lead wiper 302 and components of the lead wiper 302 when the lead wiper 302 is milled up after completion of the cementing process.

Figure 9A:
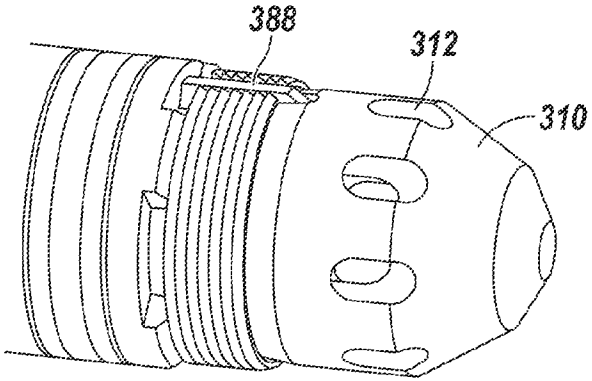
FIGS. 9A-9C show a perspective view and partial cross-section views with an open port position and a closed port position.
Figure 9C:
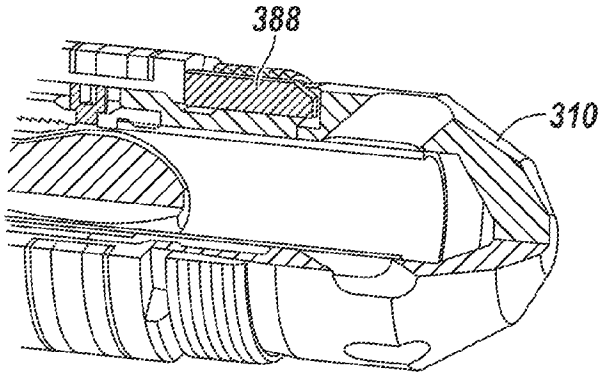
Figure 9B:
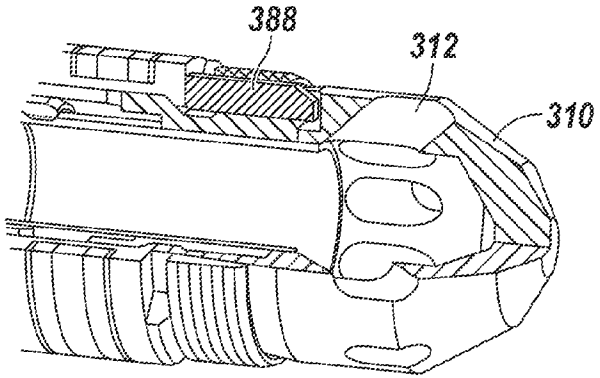

FIGS. 9A-9C show a perspective view and partial cross-section views with an open port position and a closed port position of a lower end of the lead wiper 302 with the key 388 extending through an axial opening of the snap ring 319. The key 388 is coupled between the nose 310 and the snap ring 319 and prevents rotation of the lower end of the lead wiper 302 when the lead wiper 302 is milled up from the landing collar (not shown).

Referring back to FIG. 7A, the body 308 includes a bore 316 therethrough. The lead wiper 302 includes at least one sleeve 311 disposed in the bore 316. The at least one sleeve 311 includes a threaded portion 314 disposed on the inner surface of the sleeve 311. In one embodiment, the threaded portion 314 may be a ratchet thread. In certain embodiments, the lead wiper 302 may include a first sleeve 311 and a second sleeve 313 coupled to the first sleeve 311, wherein a threaded portion 314 may be disposed on the inner surface of one of the first sleeve 311 and the second sleeve 313. As shown, the second sleeve 313 may be disposed axially below the first sleeve 311. In the run-in position, the first and second sleeves 311, 313 are positioned axially above the ports 312, such that the ports 312 are open. In one embodiment, the threaded portion 314 may be disposed proximate the upper end of the lead wiper 302, but in other embodiments, the threaded portion 314 may be disposed proximate the middle or lower end of the lead wiper 302.

One or more axial slots 331 may be formed in the body 308 of the lead wiper 302 configured to engage one or more anti-rotation devices 333 coupled to the first sleeve 311. The anti-rotation devices 333 may include a bolt or a key configured to fit within the axial slots 331 and prevent rotation of the first sleeve 311 when the lead wiper 302 and components of the lead wiper 302 are milled up after completion of the cementing process. The anti-rotation devices 333 are be configured to move axially within the one or more axial slots 331 when the first sleeve 311 shirts axially downward, but are prevented from rotating. Preventing rotation of the components of the lead wiper 302 during milling up may provide a quicker, more efficient milling process. Similarly, one or more slots 335 may be formed in the body 320 of the follow wiper 304 configured to engage one or more anti-rotation devices 337 coupled to a third sleeve 315 of the follow wiper 304. The anti-rotation devices 337 may include a bolt or a key configured to fit within the slots 335 and prevent rotation of third sleeve 315 of the follow wiper 304, when the follow wiper 304 and the components of the follow wiper 304 are milled up.

The follow wiper 304 includes a tubular body 320 and a landing nose 322 disposed on a lower end of the tubular body 320. In one embodiment, a lower end of the landing nose 322 may include a plurality of castellations 283, as shown in FIG. 4. The castellations 283 are configured to provide quicker and more efficient milling up of the follow wiper 304 after landing in the landing collar (not shown). As shown in FIG. 7A, the one or more wiping fins 306*b* are coupled to the body 320 by any means known in the art, for example, mechanical fasteners, co-molding, press fit, etc. A snap ring 321 may be disposed around the follow wiper 304 proximate the landing nose 322. The snap ring 321 may include a threaded outer surface configured to engage a corresponding threaded surface of the landing collar (not shown) to secure the follow wiper 304 in the landing collar (not shown). In one embodiment, the threaded outer surface of the snap ring 321 and the corresponding threaded surface of the landing collar (not shown) may be ratchet threads, so as to prevent the follow wiper 304 from moving axially upward when engaged. A key 377 may be disposed in the snap ring 321 and configured to engage the snap ring 321 to the follow wiper 304 to prevent rotation of the follow wiper 304 and components of the follow wiper 304 when the follow wiper 304 is milled up after completion of the cementing process.

The body 320 of the follow wiper 304 includes a bore 324 therethrough. The follow wiper 204 includes a third sleeve 315 disposed in the bore 224. The third sleeve 315 includes an internal shoulder 317, such that an inside diameter of the third sleeve 315 proximate the upper end of the shoulder 317 is larger than an inside diameter of the sleeve 215 proximate the lower end of the shoulder 217. The shoulder may be sloped or may be formed as a right angle. As shown, the lower end of the third sleeve 315 may be configured to receive the upper end of the first sleeve 311 of the lead wiper 302 within the bore 324.

A first collet ring 330 is coupled to the upper end of the body 308 of the lead wiper 302. The first collet ring 330 may be coupled to the body 320 by any means known in the art, for example, threaded connection, welding, press-fit, or mechanical fasteners, such as bolts, screws, or shear screws. The first collet ring 330 includes at least one collet finger 332 extending axially upward and configured to engage the body 320 of the follow wiper 304. One of ordinary skill in the art will appreciate that the first collet ring 330 may include a cylindrical ring having one or more collet fingers 332 extending therefrom or may include one or more collet fingers individually coupled to the lead wiper 302. At least one shear screw 323 may be engaged with the first collet ring 330 and extend radially inward to engage a groove 325 formed in an outer surface of the first sleeve 311.

The one or more collet fingers 332 each include a collet head 334 configured to engage an inner ring 375 coupled to the follow wiper 304, so as to couple the lead wiper 302 to the follow wiper 304. The collet head 334 includes an extension portion that extends radially outward from the collet finger 332, such that the extension portion engages an upper end of the inner ring 375 of the follow wiper 304. As shown in FIG. 7A, the inner ring 375 is coupled to the body 320 of the follow wiper 304 by one or more shear screws 373. One or more seals 379 may be disposed around the inner ring 375 between the inner ring 375 and the inner surface of the body 320 of the follow wiper 304. The shear screws 373 of the inner ring 375 have a predetermined pressure rating that is higher than the other actuation mechanisms of the dual plug wiper system 300. Specifically, the pressure rating of the shear screws 373 of the inner ring 375 is higher than the pressure rating of the shear screws 325 coupling first collet ring 330 and the first sleeve 311 and shear screws 343 coupling a second collet ring 351 and the third sleeve 315 of the follow wiper 304. The inner ring 375 and the at least one shear screw 373 provide a safety mechanism for releasing the lead wiper 302 and the follow wiper 304 in the event of an emergency, for example, when the lead sleeve is jammed and the pressure cannot otherwise be released. Actuation of the lead wiper 302 and follow wiper 304 in accordance with this embodiment is described in more detail below. When a predetermined pressure is applied to the tool that is greater than the predetermined pressure rating of the at least one shear screw 373, the shear screw 373 shears and the inner ring 375 is configured to move axially downward within an axial slot 365 formed between the body 320 of the follow wiper 304 and the collet ringer 332.

When the follow wiper 304 and the lead wiper 302 are coupled together (e.g., when the lead and follow wipers 302, 304 are run into the hole and positioned at the top of a liner) an outer diameter of the first sleeve 311 contacts the inner surface of the collet head 334 of the at least one collet finger 332, thereby maintaining the collet head 334 in contact with the inner surface of the follow wiper 304 body 320. Contact between the collet head 334 and the upper surface of the inner ring 375 coupled to the follow wiper 304 body 320 maintains engagement of the lead and follow wipers 302, 304.

A second collet ring 351 is coupled to the lower end of the running tool 344. The second collet ring 351 may be coupled to the running tool 344 by any means known in the art, for example, threaded connection, welding, press-fit, or mechanical fasteners, such as bolts, screws, or shear screws. The second collet ring 351 includes at least one collet finger 354 extending axially downward and configured to engage the body 320 of the follow wiper 304. One of ordinary skill in the art will appreciate that the second collet ring 351 may include a cylindrical ring having one or more collet fingers 354 extending therefrom or may include one or more collet fingers 354 individually coupled to the running tool 344. At least one shear screw 343 may be engaged with the second collet ring 351 and extend radially inward to engage a groove 345 formed in an outer surface of the sleeve 315.

The one or more collet fingers 354 each include a collet head 352 configured to engage a groove 350 formed on the inner surface of the body 320, so as to couple the follow wiper 304 to the running tool 344. The collet head 352 includes an extension portion that extends radially outward from the collet finger 354, such that the extension portion engages the groove 350 of the follow wiper 304 body 320 and abuts an upset 348. The upset 348 may be formed on the inner surface of the body 320 axially above the groove 350 or the upset 348 may be formed by a secondary ring 353 coupled to the body 320 of the follow wiper 204.

When the follow wiper 304 and the running tool 344 are coupled together (e.g., when the lead and follow wipers 302, 304 are run into the hole and positioned at the top of a liner) an outer diameter of the sleeve 315 of the follow wiper 304 contacts the inner surface of the collet head 352 of the at least one collet finger 354, thereby maintaining the collet head 252 in the groove 350 of the follow wiper 302 body 320. Contact between the collet head 352 and the upset 348 of the follow wiper 302 body 320 maintains engagement of the follow wiper 304 and the running tool 344.

To decouple the lead wiper 302 from the follow wiper 304, a first PDP (not shown) may be released from the surface into the drill string. When the first PDP (not shown) is run downhole, the first PDP becomes engaged with the first sleeve 311 of the lead wiper 302. In this embodiment, a split ring (not shown) of the first PDP engages the threaded portion 314 disposed on the inner surface of the sleeve 311 to secure the first PDP within the lead wiper 302 and seal the bore 316 of the lead wiper 302. An outer surface of the split ring (not shown) may include a ratchet thread and the threaded portion 314 of the sleeve 311 may be a corresponding ratchet thread, such that engagement of the threaded portions provides locking engagement of the first PDP with the lead wiper 302 that prevents the first PDP from moving axially upward.

Figure 7B:
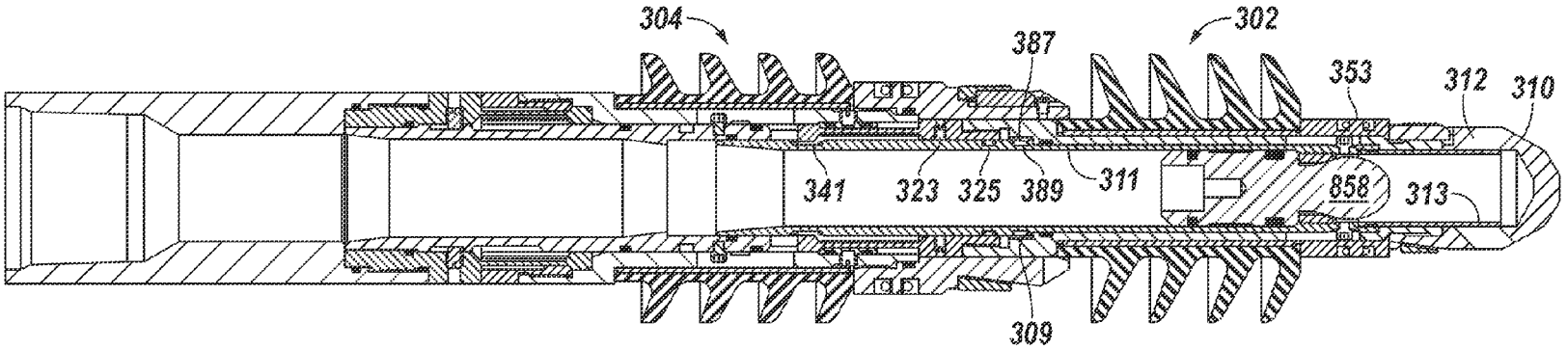
FIG. 7B is a cross-sectional view of the dual wiper plug system of FIG. 7A with a first pump down plug in accordance with embodiments disclosed herein.

Referring to both FIGS. 7A and 7B, hydraulic pressure applied behind the first PDP 858 by the pumped volume of cement (not shown) causes the first PDP 358 to move the first sleeve 311 axially downward, shearing the shear pins 323, until the second sleeve 313 engages or abuts an inside surface of the nose 310 of the lead wiper 302. When the second sleeve 313 engages the nose 310, the ports 312 are closed by the sleeve 313. The first sleeve 211 may include a snap ring 387 disposed in a circumferential groove 389 formed in an outer surface of the first sleeve 311. The snap ring 387 and circumferential groove 389 may be located axially below the groove 325 formed in the first sleeve 311 configured to receive at least one shear screw 323. The snap ring 387 may be biased radially outward. In the run-in position, the snap ring 387 is compressed within the groove 389 by contact engagement with the inner surface of the first collet ring 330. As the first sleeve 311 moves axially downward, the snap ring 387 may radially align with a groove or shoulder 309 on the inside diameter of the body 308 of the lead wiper 302, thereby allowing the snap ring 387 to expand radially outward to secure the first sleeve 311 to the body 308.

The first sleeve 311 also includes a groove 341 or a reduced outer diameter portion. When the tool is run-in, the groove 341 is spaced axially above the collet head 334 a distance approximately equal to the distance between a lower surface of the second sleeve 313 and the inside surface of the nose 310. Thus, when the first sleeve 311 moves axially downward, the groove 341 moves into radial alignment with the collet head 334 of the first collet ring 330. As the hydraulic pressure of the volume of cement is continuously applied behind the first PDP 358, the at least one collet finger 332 may flex radially inward allowing the collet head 334 to engage the groove 341 of the first sleeve 311 and disengage from the upper end of the inner ring 375, thereby decoupling the lead wiper 302 from the follow wiper 304.

Figure 7C:
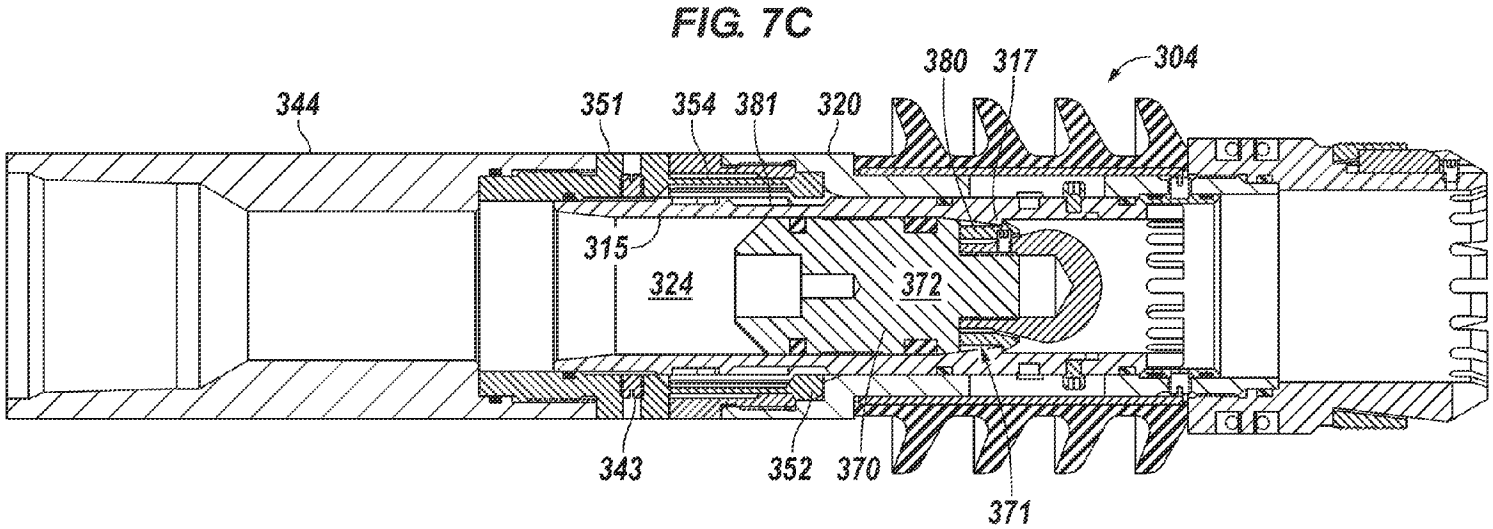
FIG. 7C is a cross-sectional view of a follow wiper released from the dual wiper plug system of FIG. 7A in accordance with embodiments disclosed herein.

FIG. 7C show the follow wiper 304 coupled to the running tool 344 after the lead wiper 302 (FIG. 7B) has been decoupled from the follow wiper 304 and run downhole. Once a predetermined volume of cement has been pumped downhole for cementing a liner in place in a borehole, the follow wiper 304 may be decoupled from the running tool 344 and run downhole to remove any excess cement from the inside wall of the liner (not shown). To decouple the follow wiper 304 from the running tool 344, a second PDP 370 may be released from the surface after the volume of cement has been pumped downhole. Drilling fluid may be pumped behind the second PDP 370 to push the second PDP 370 down hole into the bore 324 of the follow wiper 304. A split ring 380 is disposed around the body 372 of the second PDP 370 proximate the nose portion 374. The split ring 380 may include a latching mechanism 371, for example a collet finger or latching dog, configured to engage a shoulder 317 of the sleeve 315 of the follow wiper 304. The latching mechanism 371 may include an axial portion and an extension portion such that the axial portion is configured to flex radially inward as the extension portion passes through the shoulder 317 and radially outward after the extension portion has passed through the shoulder 317. The extension portion may then be engaged with the shoulder 317 such that the second PDP 370 may not move axially upward. In other embodiments, an outer surface of the split ring 380 may include a threaded portion. In one embodiment, the outer surface of the split ring 380 may include a ratchet thread configured to engage a threaded portion (not shown) disposed on the inside surface of the body 320 of the follow wiper 304.

The second PDP 370 is similar to the second PDP 170 described above with reference to FIG. 1. The outside diameter of the body 372 of the PDP 370 is approximately equal to or slightly less than the inside diameter of the sleeve 315. When the second PDP 370 is run downhole, the second PDP 370 engages the shoulder 317 of the sleeve 315, thereby sealing the bore 324 of the follow wiper 304.

Referring to both FIGS. 7A and 7C, hydraulic pressure applied behind the engaged second PDP 370 by the pumped drill fluid (not shown) causes the second PDP 370 to move the sleeve 315 axially downward. As the sleeve 315 moves, the shear screws 343 are sheared. The sleeve 315 includes a groove 381 or a reduced outer diameter portion. When the tool is run-in, the groove 381 is spaced axially above the collet head 352. When the sleeve 315 moves axially downward, the groove 381 moves into radial alignment with the collet head 352 of the second collet ring 351. As the hydraulic pressure of the volume of drill fluid is continuously applied behind the second PDP 370, the at least one collet finger 354 may flex radially inward allowing the collet head 352 to engage the groove 381 of the sleeve 315 and disengage from the groove 350 and the upset 348 of the follow wiper 304 body 320, thereby decoupling the follow wiper 304 from the running tool 344.

In the event that the second PDP 370 (FIG. 7C) is mistakenly dropped into the well before the first PDP 358 (FIG. 7B), the dual plug system 300 disclosed herein is configured to prevent premature decoupling of the follow wiper 304 from the running tool 344 if the lead wiper 302 is still coupled to the follow wiper 304. That is, the follow wiper 304 is prevented from decoupling from the dual plug system 300 if the lead wiper 302 has not yet been decoupled from the dual plug system 300.

Figure 8:
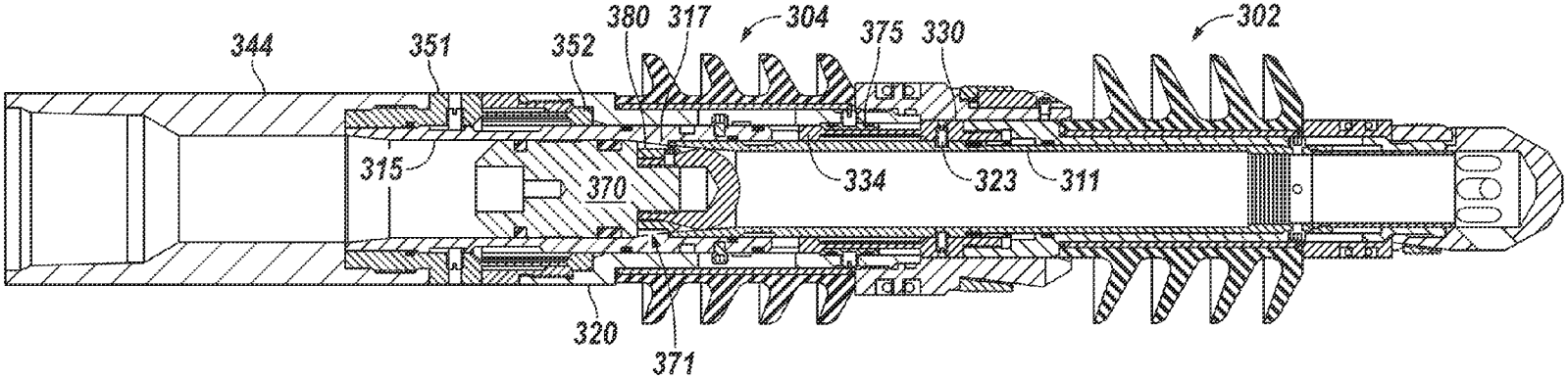
FIG. 8 is a cross-sectional view of a dual wiper plug system having a second pump down plug stuck therein in accordance with embodiments disclosed herein.

As shown in FIG. 8, where like reference characters represent like parts, in the event that the second PDP 370 is mistakenly dropped before the first PDP 358 (FIG. 7B), the first PDP 370 runs into the sleeve 315 of the follow wiper 304 until the outer diameter of the PDP 370 contacts the internal shoulder 317 of the follow wiper 304. Because the lead wiper 302 is still coupled to the follow wiper 304, the upper surface of the first sleeve 311 of the lead wiper 302 abuts a lower surface of the shoulder 317 of the follow wiper 304 sleeve 315. As such, the latching mechanism 371 of the split ring 380 of the second PDP 370 does not fully engage the internal shoulder 317 of the sleeve 315. The internal shoulder 317 provides a load bearing surface on the sleeve 315 of the follow wiper 304 as pressure is applied from above the second PDP 370, thereby preventing pressure from being applied to the first sleeve 311 of the lead wiper 302. Because pressure is not applied to the first sleeve 311 of the lead wiper 302, the shear screws 323 securing the first sleeve 311 to the first collet ring 330 remain intact and the first sleeve 311 does not move axially downward. Additionally, the collet head 334 of the first collet ring 330 remains engaged with the inner ring 375 of the follow wiper 304, thereby preventing the lead wiper 302 from being released. As shown in FIG. 8, because the sleeve 315 of the follow wiper 304 initially abuts the upper surface of the collet head 334, and because the collet head 334 remains fully engaged with the inner ring 375 of the follow wiper 304, the sleeve 315 is prevented from moving axially downward. Because the sleeve 315 is prevented from moving axially downward, the collet head 352 of the second collet ring 351 remains engaged with the body 320 of the follow wiper 304, thereby preventing the follow wiper 304 from decoupling from the running tool 344. In this embodiment, another downhole tool, for example a fishing tool, may be run inside the running tool 344 and latched onto the second PDP 370 to retrieve the second PDP 370 from the dual plug system 300. Subsequently, the first PDP 358 (FIG. 7B) may be run downhole to decouple the lead wiper 302 from the follow wiper 304, as described in detail above with respect to FIG. 7. In an alternate embodiment, the entire dual plug system 300 may be removed from the well and the second PDP 370 removed from the dual plug system 300 at the surface. The dual plug system 300 may then be run back into the well and used to cementer the liner (not shown) as described above with reference to FIG. 7.

In yet another embodiment, the dual plug system 300 includes a safety mechanism that allows both the lead and follow wipers to be released in the event that the second PDP 370 is run downhole before the first PDP 358 (FIG. 7B) or if the first sleeve 311 is jammed or stuck. In such an embodiment where the drill string cannot be picked up due to the pressure differentials across the system, the pressure may be released by actuating the inner ring 375 to decouple the lead wiper 302 from the follow wiper 304 and the follow wiper 304 from the running tool 344. Referring back to FIG. 7A, and as discussed above, the dual wiper plug system 300 includes at least three stages or sets of at least one shear screw coupling components of the system 300 together. A first set of shear screws 323 couples the first sleeve 311 of the lead wiper 302 and the first collet ring 330. A second set of shear screws 343 couples the third sleeve 315 of the follow wiper 304 and the second collet ring 351. A third set of shear screws 373 couples the inner ring 375 and the body 320 of the follow wiper 304.

The first set of shear screws 343 is rated to withstand a first pressure, the second set of shear screws 343 is rated to withstand a second pressure, wherein the second pressure is higher than the first pressure, and the third set of shear screws 373 is rated to withstand a third pressure, wherein the third pressure is greater than each of the first and second pressures. This varying pressure rating allows the lead wiper 302 to decouple from the dual wiper plug system 300 at a lower pressure than the pressure required to decouple the follow wiper 304 from the running tool 344. In the event that there is a problem or emergency downhole and the dual wiper plug system 300 needs to be released from the running tool 344, the pressure inside the system 300 may be increased to a third pressure, i.e., above the pressure rating of the third set of shear screws 373 to decouple the system 300.

If the first sleeve 311 is jammed or if the second PDP 370 is run downhole first, the pressure may be increased up past the third pressure rating, i.e., the rating of the third set of shear screws 373. Thus, as the pressure is increased up through the second pressure rating, i.e., the rating of the second set of shear screws 343, the second set of shear screws 343 shear. The third sleeve 315 applies a load against the collet head 334 of the lead wiper 302 and the load is transferred to the inner ring 375, until the pressure is increased up to or above the third pressure rating, thereby shearing the third set of shear screws 373. The distance of travel of the third sleeve 315 and the corresponding groove 345 on the third sleeve 315 once the second set of shear screws 343 shear is greater than a distance of travel of the inner ring 375 within axial slot 365. When the third set of shear screws 373 shears, the inner ring 375 shifts axially downward and allows the lead wiper 302 to decouple from the follow wiper 304. Once the sleeve 315 moves axially downward as a result of the inner ring 375 moving axially downward, the lead wiper 302 is decoupled from the follow wiper 304 and the follow wiper 304 decouples from the running tool 344.

Figure 14A:
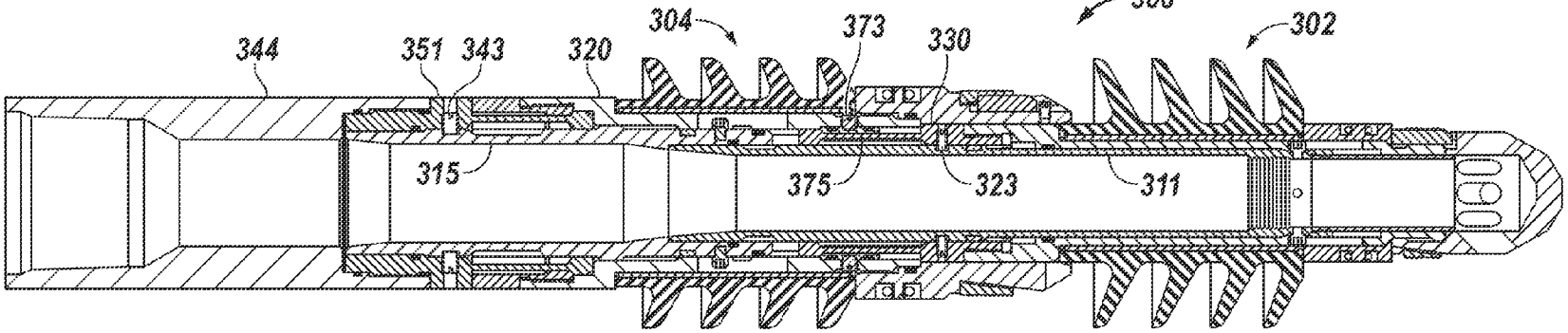
FIGS. 14A and 14B are cross-sectional views of a dual wiper plug system in accordance with embodiments disclosed herein.
Figure 14B:
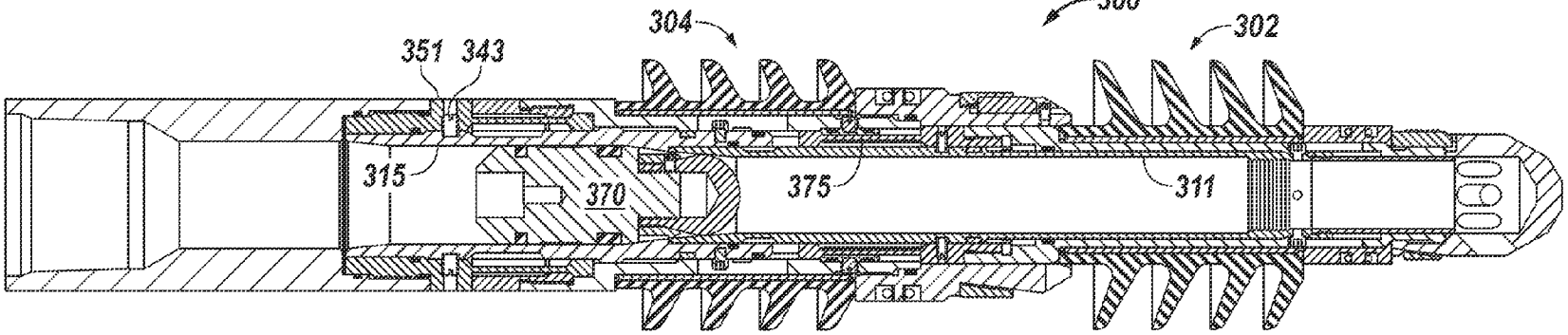

In another embodiment, as shown in FIGS. 14A and 14B, if the second PDP 370 is run downhole before the first PDP 358 (FIG. 7B) or if the first sleeve 311 is jammed or stuck, the pressure differential across the system may be released by actuating the inner ring 375 to decouple the lead wiper 302 from the follow wiper 304 and the follow wiper 304 from the running tool 344. As discussed above, the dual wiper plug system 300 includes at least three stages or sets of at least one shear screw coupling components of the system 300 together. One or ordinary skill in the art will appreciate that a shear ring may be used instead of a shear screw without departing from embodiments disclosed herein. A first set of shear screws 323 couples the first sleeve 311 of the lead wiper 302 and the first collet ring 330. A second set of shear screws 343 couples the third sleeve 315 of the follow wiper 304 and the second collet ring 351. A third set of shear screws 373 couples the inner ring 375 and the body 320 of the follow wiper 304.

In this embodiment, the shear screw 343 is provided in the second collet ring 351, such that the upper and lower sides of the shear screw 343 are in contact with the third sleeve 315. That is, the shear screw 343 engages the groove 345 of the third sleeve 315, wherein the axial length of the groove 345 is approximately equal to or slightly larger than the axial width of the shear screw 343. Accordingly, when an incorrect plug is dropped, the pressure increase due to the dropped plug loads both the second and third sets of shear screws 343, 373 simultaneously. The addition of the ratings of the second and third sets of shear screws 343, 373 define the pressure load at which the second and third sets of shear screws 343, 373 will shear.

The first set of shear screws 343 is rated to withstand a first pressure, the second and third sets of shear screws 343, 373 are rated to withstand a second pressure, wherein the second pressure is higher than the first pressure. This varying pressure rating allows the lead wiper 302 to decouple from the dual wiper plug system 300 at a lower pressure than the pressure required to decouple the follow wiper 304 from the running tool 344. In the event that there is a problem or emergency downhole and the dual wiper plug system 300 needs to be released from the running tool 344, the pressure inside the system 300 may be increased to a second pressure, i.e., above the pressure rating of the second and third sets of shear screws 343, 373 to decouple the system 300, as described above.

If the first sleeve 311 is jammed or if the second PDP 370 is run downhole first, the pressure may be increased up past the second pressure rating, i.e., the rating of the third set of shear screws 373. Thus, as the pressure is increased, the second collet ring 351 applies a load against the second set of shear screws 343, the third sleeve 315 applies a load against the collet head 334 of the lead wiper 302, and the load is transferred to the inner ring 375, until the pressure is increased up to or above the second pressure rating, thereby shearing the second and third set of shear screws 343, 373. When the third set of shear screws 373 shears, the inner ring 375 shifts axially downward and allows the lead wiper 302 to decouple from the follow wiper 304. Once the sleeve 315 moves axially downward as a result of the inner ring 375 moving axially downward, the lead wiper 302 is decoupled from the follow wiper 304 and the follow wiper 304 decouples from the running tool 344. The high pressure rating of the second and third sets of shear screws 343, 373 provides an indication at the surface that the wrong PDP has been dropped and engaged within the dual wiper plug system 300. Thus, the shear screw 373 provides a contingency release of the lead wiper 302 or a safety release of the dual wiper plug system 300 in the event that the wrong plug is dropped.

Figure 10:
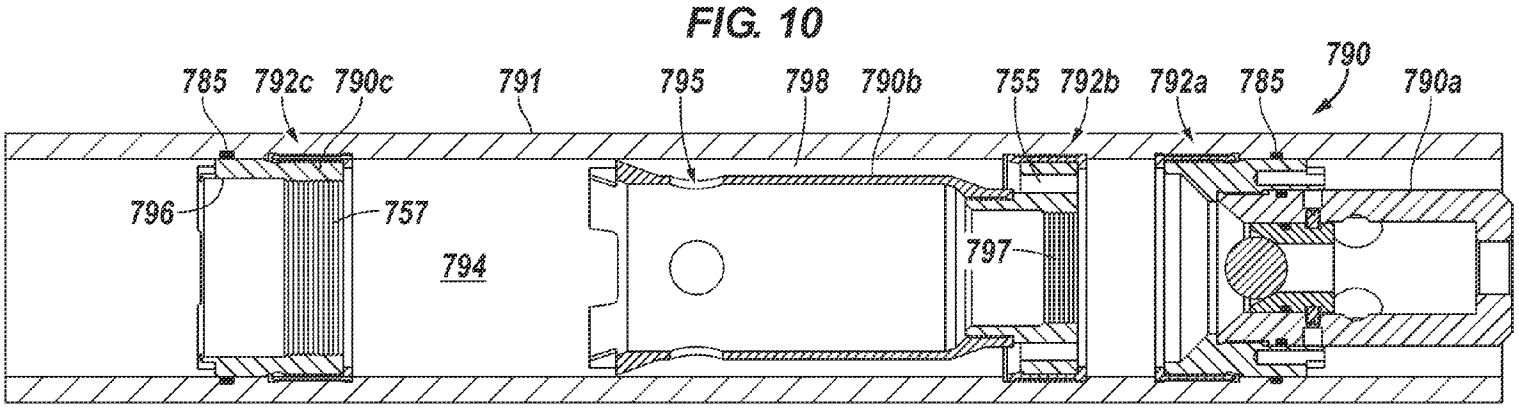
FIG. 10 is a cross-sectional view of a landing collar disposed below a liner in accordance with embodiments disclosed herein.
Figure 11:
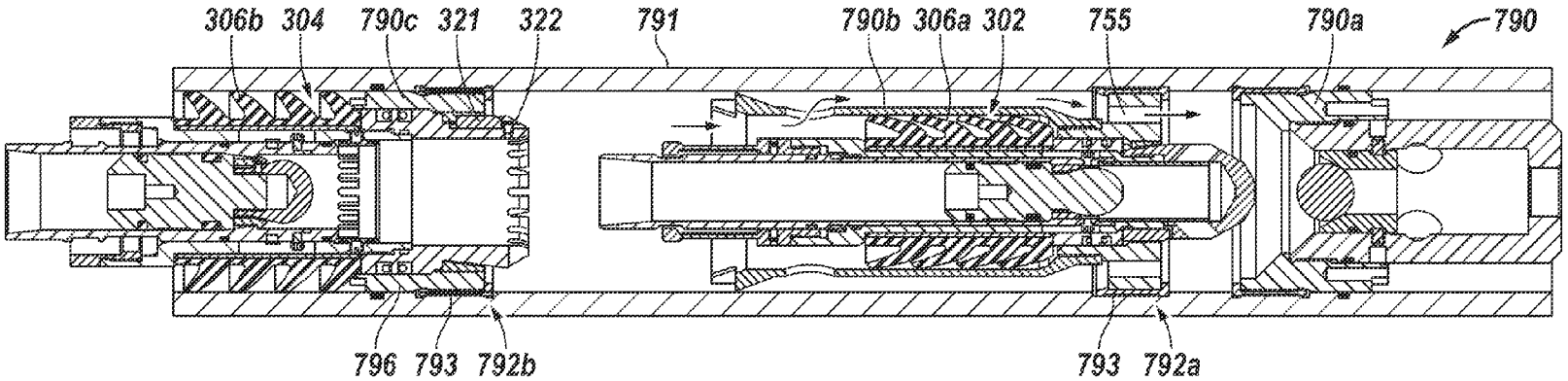
FIG. 11 is a cross-sectional view of a lead wiper and a follow wiper landed in a landing collar below a liner in accordance with embodiments disclosed herein.

Referring now to FIGS. 10 and 11, a landing collar 790 disposed in a housing 791 coupled to a lower end of a liner (not shown) is shown. As shown, the landing collar 790 includes a first portion 790*a* for receiving a ball drop mechanism, a second portion 790*b* for receiving the lead wiper 302, and a third portion 790*c* for receiving the follow wiper 304. Each portion 790*a*, 790*b*, 790*c* of the landing collar 790 is coupled to the housing 791 by at least one latching mechanism 792. The latching mechanism 792 may be any device used for securing a tubular body within a housing known in the art, for example, locking dogs, ratchet split rings, anchoring devices, etc. One or more seals 785 may be disposed around at least a portion of the landing collar 790 and configured to seal between the landing collar 790 and the housing 791. A central bore 794 is disposed through the landing collar 790 includes.

The second portion 790*b* of the landing collar 790 includes at least one upper radial port 795 disposed proximate the upper end of the landing collar 790. The landing collar 790 is configured to receive the lead wiper 302 after it has been released from the dual plug system 300 (FIG. 7A) at the top of the liner. When the lead wiper 302 is decoupled from the dual plug system 300 (FIG. 7A), as described above, the fluid pressure of the volume of cement behind the lead wiper 302 moves the lead wiper 302 axially downward to the lower end of the liner (not shown) and seats the lead wiper 302 in the landing collar 390. The threaded outer surface of the snap ring 319 disposed around the lead wiper 302 engages a corresponding threaded surface 797 of the landing collar 790 to secure the lead wiper 302 in the landing collar 790. In one embodiment, the threaded outer surface of the snap ring 319 and the corresponding threaded surface 797 of the landing collar 790 may be ratchet threads, so as to prevent the lead wiper 302 from moving axially upward when engaged. As shown, when the lead wiper 302 moves into an upper end of the landing collar 790, the at least one wiping fin 306*a* is flexed or compressed within the second portion 790*b* of the landing collar 790. As shown, at least a portion of an outside diameter of the landing collar 790 is less than the inside diameter of the liner 790, thereby providing an annulus 798. As shown, the annulus 798 may be disposed between first latching mechanism 792*a* and second latching mechanism 792*b*. Additionally, the at least one upper radial port 795 of the landing collar 790 radially aligns with the annulus 698.

Once the lead wiper 302 is seated and engaged within the landing collar 790, cement may flow around the lead wiper to cement the outside diameter of the liner 790 in place. The cement flows around the lead wiper 302. When the lead wiper 302 seats within the landing collar 790, the lead wiper 302 is disposed axially above the at first portion 790*a* of the landing collar 790 and the compressed wiping fins 306*a* are disposed axially below the at least one upper radial port 395. Specifically, the volume of cement behind the lead wiper 302 flows from behind the compressed wiping fins 306*a* through the at least one upper radial port 795 into the annulus 798. The cement then flows axially downward in the annulus 798 and through axial openings 755 of the first latching mechanism 792*a*. The cement may then flow radially inward back into the bore 794 of the landing collar 790. The landing collar thereby provides a bypass assembly in which the cement may flow around the lead collar 302 seated within the landing collar 790. The cement may then be pumped upward between the liner and the formation (not shown) or other tubular (not shown) and allowed to cure.

Once the volume of cement has been pumped around the lead wiper 302 seated within the landing collar 790, the follow wiper 304 lands within the upper end of the third portion 790*c* of the landing collar 790 above the lead wiper 302. The snap ring 321 disposed around the follow wiper 304 proximate the landing nose 322 engages an inside surface of the upper end of the landing collar 790. As shown, the snap ring 321 may include a threaded outer surface configured to engage a corresponding threaded surface 757 of the landing collar 790 to secure the follow wiper 304 in the landing collar 790. In one embodiment, the threaded outer surface of the snap ring 321 and the corresponding threaded surface 757 of the landing collar 790 may be ratchet threads, so as to prevent the follow wiper 304 from moving axially upward when engaged. The latched follow wiper 304 seals the bore 794 of the landing collar 790 to prevent the cement from re-entering the drill string (not shown).

Figure 12:
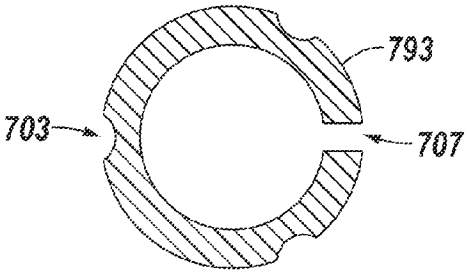
FIG. 12 is a cross-sectional view of a component of the landing collar of FIGS. 10 and 11.

Referring to FIGS. 10-12 together, the latching mechanism 792 of the landing collar 790 includes a landing insert 796 and a threaded c-ring 793 configured to collapse when initially installed and expand into threaded engagement with the landing insert 796. An outer diameter of the c-ring 793 includes a threaded portion configured to engage a threaded portion of the housing 791. The space or gap 707 provided in the c-ring 793 allows the c-ring to compress when installed in the housing 791 of the landing collar 790 and to expand radially into engagement with the housing 791 when the landing insert 796 is inserted in the c-ring 793. The c-ring 793 further includes at least one notch 703 formed on an outside diameter. Specifically, the at least one notch 703 is configured to allow the c-ring to be efficiently milled up when the wipers 302, 304 are milled up from the landing collar 790. Specifically, the mill (not shown) may have a limited diameter due to the diameter of the housing 791. By forming notches 703 on the outside diameter of the c-ring 793, the mill only has to drill a diameter defined by the diameter between the notches 703 until the c-ring 793 breaks up into pieces. Small pieces of the c-ring 793 during milling helps fully mill the components without spinning and allows for the small pieces to be more easily returned to the surface.

In certain applications, a single wiper plug system in accordance with embodiments disclosed herein may be used instead of a dual wiper plug system. In this embodiment, a follow wiper as described above with reference to the figures above may be run downhole on a running tool and held proximate the top of the liner. A pump down plug as described above with reference to the second PDP of the figures above may be dropped to decouple the follow wiper from the running tool.

Figure 13:
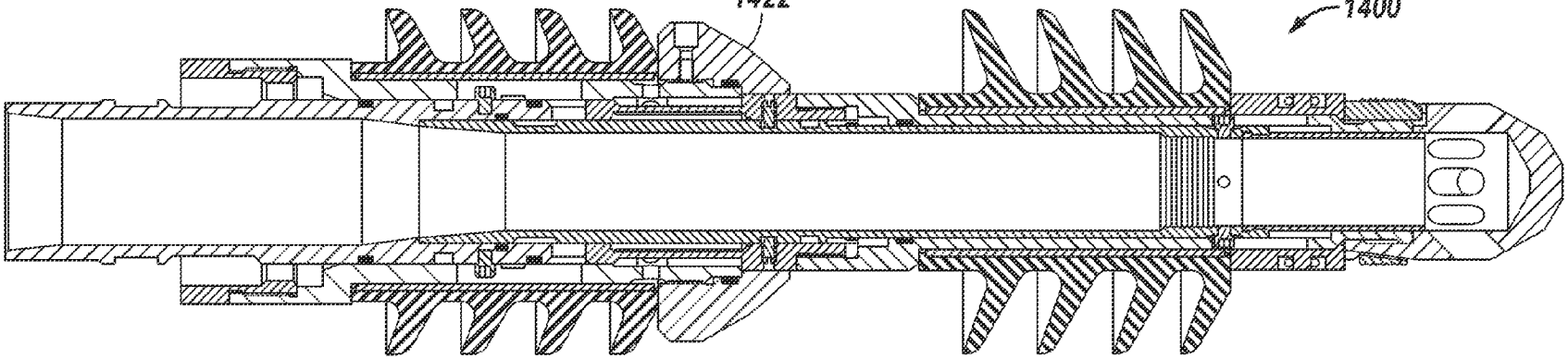
FIG. 13 is a stage cementing tool in accordance with embodiments disclosed herein.

In other embodiments, one or more wiper plugs disclosed above may be used for various applications. In one embodiment, the nose section of the lead or follow plug may be decoupled from the wiper and changed with another landing nose. The nose may be configured to seat within a specific downhole tool, such that when the wiper plug is run downhole, other downhole tools may be actuated. For example, FIG. 13 shows a wiper plug system 1400 used as a stage cementing tool. The wiper plug system 1400 includes a lead wiper 1402 and a follow wiper 1404. The follow wiper 1404 includes a nose 1422 that is configured to activate stage tools. Thus, a wiper plug system in accordance with embodiments disclosed herein may advantageously allow for the system to be used in various downhole operations that require the activation or deactivation of a port or system.

Advantageously, embodiments disclosed herein provide a dual wiper plug system having a lead wiper and a follow wiper that prevents premature release of the lead wiper due to, for example, impact from above. Additionally, a dual wiper plug system in accordance with embodiments disclosed herein may allow for release and proper functioning of a lead wiper if a first PDP becomes stuck in the dual wiper plug system. Further, in the event that the second PDP is dropped before the first PDP, a dual wiper plug system in accordance with embodiments disclosed herein advantageously prevents the follow wiper from releasing from the running tool before the lead wiper is released.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A landing collar comprising:

a housing;

a first sleeve configured to receive a lead wiper plug, wherein the first sleeve comprises at least one bypass port; and at least one latching mechanism configured to couple the first sleeve to an inner wall of the housing, wherein the at least one latching mechanism comprises a c-ring coupled to the housing and a landing insert disposed within the c-ring, wherein the c-ring comprises at least one notch formed on an outer surface thereof.

2. The landing collar of claim 1, further comprising a second sleeve configured to receive a follow wiper plug, wherein the follow wiper provides a seal within the housing when seated in the second sleeve.

3. The landing collar of claim 2, further comprising a second latching mechanism configured to couple the second sleeve to the inner wall of the housing, wherein the at least one latching mechanism comprises a c-ring coupled to the housing and a landing insert disposed within the c-ring.

4. The landing collar of claim 1, further comprising structure for receiving a ball drop mechanism.

5. The landing collar of claim 1, further comprising a threaded surface disposed on an inner surface of the first sleeve configured to engage a threaded surface of the lead wiper plug.

6. The landing collar of claim 5, wherein the threaded surface disposed on the inner surface of the first sleeve comprises a ratchet thread.

7. The landing collar of claim 5, wherein the threaded surface of the lead wiper plug comprises a ratchet thread.

* * * * *